US010203173B2

(12) United States Patent
Ellis et al.

(10) Patent No.: US 10,203,173 B2
(45) Date of Patent: Feb. 12, 2019

(54) BARREL LOCKING MECHANISM FOR A FIREARM

(71) Applicants: Jameson S. Ellis, Sag Harbor, NY (US); Paul H. Ellis, Sr., Washington, DC (US)

(72) Inventors: Jameson S. Ellis, Sag Harbor, NY (US); Paul H. Ellis, Sr., Washington, DC (US)

(73) Assignee: Jameson S. Ellis, Sag Harbor, NY (US)

( * ) Notice: Subject to any disclaimer, the term of this patent is extended or adjusted under 35 U.S.C. 154(b) by 1 day.

(21) Appl. No.: 15/494,452

(22) Filed: Apr. 22, 2017

(65) Prior Publication Data

US 2018/0306536 A1 Oct. 25, 2018

(51) Int. Cl.

| | |
|---|---|
| ***F41A 3/36*** | (2006.01) |
| ***F41A 3/38*** | (2006.01) |
| ***F41A 3/44*** | (2006.01) |
| ***F41A 5/02*** | (2006.01) |

(52) U.S. Cl.

CPC *F41A 3/36* (2013.01); *F41A 3/38* (2013.01); *F41A 3/44* (2013.01); *F41A 5/02* (2013.01)

(58) Field of Classification Search

CPC ..... F41A 3/36; F41A 3/38; F41A 3/44; F41A 5/02

USPC ..... 89/173, 174, 175, 176

See application file for complete search history.

(56) References Cited

U.S. PATENT DOCUMENTS

| | | | | | |
|---|---|---|---|---|---|
| 1,985,493 | A * | 12/1934 | Gebauer | F41A 3/38 | 89/169 |
| 3,408,895 | A * | 11/1968 | Lopez | F41A 3/40 | 89/145 |
| 4,201,113 | A * | 5/1980 | Seecamp | F41A 3/86 | 89/163 |
| 4,594,935 | A * | 6/1986 | Smith | F41A 17/36 | 42/75.02 |
| 4,854,217 | A * | 8/1989 | Ransom | F41A 3/14 | 89/163 |
| 4,915,011 | A | 4/1990 | Smith | | |
| 5,216,191 | A | 6/1993 | Fox | | |
| 5,433,134 | A * | 7/1995 | Leiter | F41A 3/54 | 89/14.5 |
| 5,581,046 | A * | 12/1996 | Weldle | F41A 3/86 | 89/163 |
| 5,734,120 | A | 3/1998 | Besselink | | |
| 6,363,831 | B2 * | 4/2002 | Gussalli Beretta | F41A 5/04 | 89/163 |
| 6,993,864 | B1 | 2/2006 | O'Clair et al. | | |
| 7,673,553 | B2 * | 3/2010 | Lippard | F41A 5/04 | 42/75.01 |
| 7,707,923 | B2 * | 5/2010 | Gussalli Beretta | F41A 3/26 | 42/40 |
| 8,752,474 | B2 * | 6/2014 | Vanek | F41A 5/06 | 89/198 |
| 2005/0257413 | A1 * | 11/2005 | Zimmermann | F41A 5/04 | 42/75.1 |

(Continued)

*Primary Examiner* — Joshua E Freeman

(74) *Attorney, Agent, or Firm* — Walters & Wasylyna LLC

(57) ABSTRACT

A locking mechanism for a firearm including a frame, a slide, a barrel and a firing mechanism is disclosed. The locking mechanism includes a body to engage the barrel and a slide lock extending from the body to engage the slide. With the slide in a forward position, the slide lock extends at least partially through an ejection port of the slide to engage the barrel with the slide.

20 Claims, 10 Drawing Sheets

(56) References Cited

U.S. PATENT DOCUMENTS

| | | | | |
|---|---|---|---|---|
| 2007/0012170 | A1 | 1/2007 | Spielberger | |
| 2011/0185885 | A1* | 8/2011 | Zimmerman | F41A 3/00 89/125 |
| 2014/0196337 | A1* | 7/2014 | Bandini | F41A 3/44 42/16 |
| 2015/0316336 | A1 | 11/2015 | Lee | |
| 2018/0087857 | A1* | 3/2018 | Davis | F41A 5/02 |

* cited by examiner

BARREL LOCKING MECHANISM FOR A FIREARM

FIELD

The present disclosure is generally related to the operation of a firearm and, more particularly, to mechanisms and methods for locking together a barrel and a slide of a semiautomatic pistol.

BACKGROUND

Semiautomatic pistols can be divided into various categories. Those that utilize a short-recoil action can be found in nearly all such firearms chambered for higher-powered cartridges (e.g., 9×19 mm Parabellum and above).

In short-recoil operated pistols, both the barrel and the slide move rearward together upon discharge of the firearm. Prior to the firing of the cartridge, the barrel is engaged to the slide by a locking mechanism. After firing, the recoil force drives both the slide and the barrel rearward. After the high-pressure period has passed (i.e., after the bullet has cleared the barrel), the barrel begins to disengage from the slide. The barrel travels a short distance before coming to rest, for example, forward of the magazine, and completely disengaging from the slide. The slide continues and begins extraction of the spent cartridge case using its kinetic energy and the residual gas pressure in the barrel. After extraction, the spent cartridge case is ejected and the slide continues until full travel is reached.

In short-recoil operated pistols, the barrel may be locked to the slide by a number of different types of locking mechanisms. As an example, the locking mechanism may include peripheral ribs, studs or lugs provided on the barrel. In this example, the locking mechanism may be cammed or rotated to engage and disengage the barrel with the slide. As another example, the locking mechanism may include a locking block that is separate from the barrel. In this example, the locking block may be tipped or vertically moved up and down to engage and disengage the barrel and the slide.

Accordingly, those skilled in the art continue with research and development efforts directed to barrel locking mechanisms for semiautomatic pistols.

SUMMARY

Disclosed is a locking mechanism for a firearm that includes a frame, a slide, a barrel and a firing mechanism. In one example, the locking mechanism includes a body to engage the barrel and a slide lock extending from the body to engage the slide. With the slide in a forward position, the slide lock extends at least partially through an ejection port of the slide to engage the barrel with the slide.

Also disclosed is a firearm. In one example, the firearm includes a frame, a barrel coupled to the frame, a slide coupled to and reciprocally movable relative to the frame, and a locking mechanism coupled to the barrel and releasably coupled to the slide. The locking mechanism includes a body engaged to the barrel and a slide lock extending from the body and engaged to the slide. With the slide in a forward position, the slide lock extends at least partially through an ejection port of the slide to lock the barrel and the slide together.

Also disclosed is a method. In one example, the method includes steps of: (1) positioning a body of a locking mechanism into engagement with a barrel of a firearm; (2) positioning a slide lock of the locking mechanism, extending from the body, at least partially through an ejection port of a slide of the firearm and into engagement with the slide; and (3) locking together the slide and the barrel.

Other examples of the disclosed locking mechanism, firearm and method will become apparent from the following detailed description, the accompanying drawings and the appended claims.

DETAILED DESCRIPTION

Figure 1:
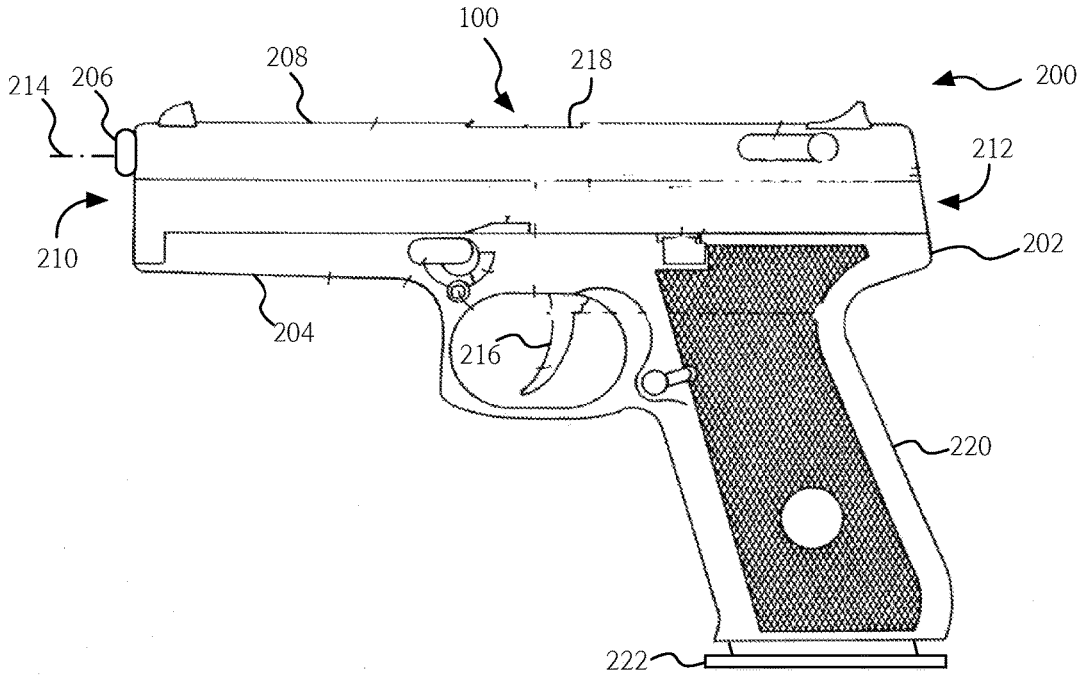
FIG. 1 is a schematic side elevation view of the disclosed firearm.

The following detailed description refers to the accompanying drawings, which illustrate specific embodiments and/or examples described by the disclosure. Other embodiments and/or examples having different structures and operations do not depart from the scope of the present disclosure. Like reference numerals may refer to the same feature, element or component in the different drawings.

Illustrative, non-exhaustive embodiments, which may be, but are not necessarily, claimed, of the subject matter according the present disclosure are provided below.

Referring to FIG. 1, the disclosed firearm 200 includes any firearm of the self-loading, locked-breech, short-recoil pistol-type. The firearm 200 is shown and described in the illustrative example as a semiautomatic pistol 202. The firearm 200 includes a frame 204 to which a barrel 206 and a slide 208 are slidably coupled.

The firearm 200 includes a forward end 210 and a longitudinally opposed rearward end 212. The frame 204 may be a unitary structure fabricated from metal or a polymer. The frame 204 is configured to house a firing mechanism (not shown) and the barrel 206. The frame 204 also includes a handgrip 220. The handgrip 220 defines an internal chamber (not shown) into which a magazine 222 is slidably received. The magazine 222 is of a conventional design in which cartridges (not shown) in a parallel, longitudinal stacked relation are biased toward a top having its front and back cut in relief to allow the cartridge to slide longitudinally out.

The barrel 206 includes a firing axis 214 (also referred to as a bore axis). The firing axis 214 defines the centerline of the barrel 206. The barrel 206 is coupled to the frame 204 for reciprocal (e.g., longitudinally rearward and forward) movement relative to the frame 204. The slide 208 is coupled to the frame 204 for reciprocal (e.g., longitudinally rearward and forward) movement relative to the barrel 206 and the frame 204. The slide 208 performs the actions resulting from the firing of a chambered cartridge (not shown).

During a firing cycle beginning with the firearm 200 in a ready-to-fire position, the slide 208 and the barrel 206 are both in a fully forward position. The disclosed locking mechanism 100 engages both the barrel 206 and the slide 208 to lock the barrel 206 and the slide 208 together. A striker-type firing pin (not shown) disposed in a rearward end portion of the slide 208 is locked in a ready position. Pulling a trigger 216 of the firearm 200 causes movement of a sear (not shown) of the firing mechanism that releases the firing pin and fires the chambered cartridge. The resulting energy released from the fired cartridge moves the barrel 206 and the slide 208 rearward compressing a recoil spring (not shown).

Upon firing, the slide 208 and the barrel 206 recoil rearward a short distance while locked together. During recoil, an empty cartridge case is extracted from the chamber of the barrel 206 by an extractor (not shown). Near an end of rearward travel of the barrel 206, the locking mechanism 100 disengages the slide 208 to unlock the barrel 206 from the slide 208. At the end of rearward travel of the barrel 206, the barrel 206 stops its rearward movement, but the unlocked slide 208 continues to move rearward. Continued rearward movement of the slide 208 ejects the empty cartridge case from an ejection port 218 formed in the slide 208 and continues to compress the recoil spring until the kinetic energy imparted to the slide 208 is overcome by the potential energy being imparted to the recoil spring as it is being compressed.

At an end of rearward travel of the slide 208, the slide 208 moves forward under a spring force of the recoil spring. Forward travel of the slide 208 loads a new cartridge into the chamber of the barrel 206 and reengages the locking mechanism 100 to the slide 208. At the end of forward travel of the slide 208, both the slide 208 and the barrel 206 return to the fully forward position with the locking mechanism 100 engaged with both the barrel 206 and the slide 208 to lock the barrel 206 and the slide 208 together.

Referring generally to FIGS. 2-16, the disclosed locking mechanism 100 releasably interconnects the barrel 206 to the ejection port 218 of the slide 208 and releasably locks the barrel 206 to the ejection port 218 of the slide 208 at certain times or positions during the firing cycle. The locking mechanism 100 includes a body 102. The body 102 is configured to engage the barrel 206. The locking mechanism 100 also includes a slide lock 104 extending from the body 102. The slide lock 104 is configured to engage the slide 208. With the barrel 206 and the slide 208 in the fully forward position, the slide lock 104 extends at least partially through the ejection port 218 of the slide 208 to engage the barrel 206 with the slide 208 and lock the barrel 206 and the slide 208 together.

The position of the locking mechanism 100 (e.g., of the body 102 and the slide lock 104) relative to the barrel 206 and the slide 208 may depend on various factors, such as the location of the ejection port 218 relative to the slide 208.

In an example, the ejection port 218 is located along a top 286 of the slide 208 and above the barrel 206. In this example, the slide lock 104 of the locking mechanism 100 is located above the barrel 206 to releasably engage the ejection port 218. Locating the slide lock 104 of the locking mechanism 100 above the barrel 206 lowers the centerline of the barrel 206 closer to the center of contact between a shooter and handgrip 220 of the firearm 200. Those skilled in the art will recognize that the recoil forces from the bullet being fired and the propellant gases exiting the muzzle act directly down the centerline of the barrel 206, which creates a rotational force. Therefore, the higher the centerline of the barrel 206 is above the center of contact between the shooter and the handgrip 220, the greater the rotational force that causes the firearm to rotate and the muzzle end to rise upward (commonly referred to as muzzle rise, muzzle flip or muzzle climb). Lowering the centerline of the barrel 206 reduces the amount of muzzle rise induced by recoil forces from the bullet being fired and the propellant gases exiting the muzzle of the barrel 206.

In another example, the ejection port 218 is located to or along one side of the slide 208 and to one side the barrel 206. In this example, the slide lock 104 of the locking mechanism 100 is appropriately located relative to the barrel 206 to releasably engage the ejection port 218.

The body 102 of the locking mechanism 100 is movable relative to the barrel 206 and the slide 208 in response to reciprocal longitudinal movement of the slide 208 along the frame 204 between the fully forward position and the fully rearward position. Movement of the body 102 in response to longitudinal movement of the slide 208 along the frame 204 from the forward position to the rearward position withdraws the slide lock 104 from the ejection port 218 to disengage the slide lock 104 from the slide 208. Disengagement of the slide lock 104 from the slide 208 disengages the barrel 206 from the slide 208 and unlocks the slide 208 from the barrel 206. Movement of the body 102 in response to longitudinal movement of the slide 208 along the frame 204 from the rearward position to the forward position advances the slide lock 104 into the ejection port 218 to engage the slide lock 104 to the slide 208. Engagement of the slide lock 104 to the slide 208 positively engages the barrel 206 to the slide 208 and locks the barrel 206 and the slide 208 together.

As will be described in more detail herein below, the body 102 of the locking mechanism 100 may move in various ways to advance and withdraw the slide lock 104 relative to the ejection port 218 of the slide 208 in response to the reciprocal longitudinal movement of the slide 208 between the forward position and the rearward position.

Referring to FIGS. 2-6, in an example of the disclosed locking mechanism 100 for the firearm 200, the body 102 may pivot to advance the slide lock 104 into the ejection port 218 and withdraw the slide lock 104 from the ejection port 218. As an example, the body 102 pivots downward relative to the slide 208 to withdraw the slide lock 104 from the ejection port 218 and unlock the slide 208 form the barrel 206 in response to the longitudinal rearward movement of the slide 208. The body 102 pivots upward relative to the slide 208 to advance the slide lock 104 within the ejection port 218 to lock the barrel 206 and the slide 208 together in response to the longitudinal forward movement of the slide 208.

Figure 2:
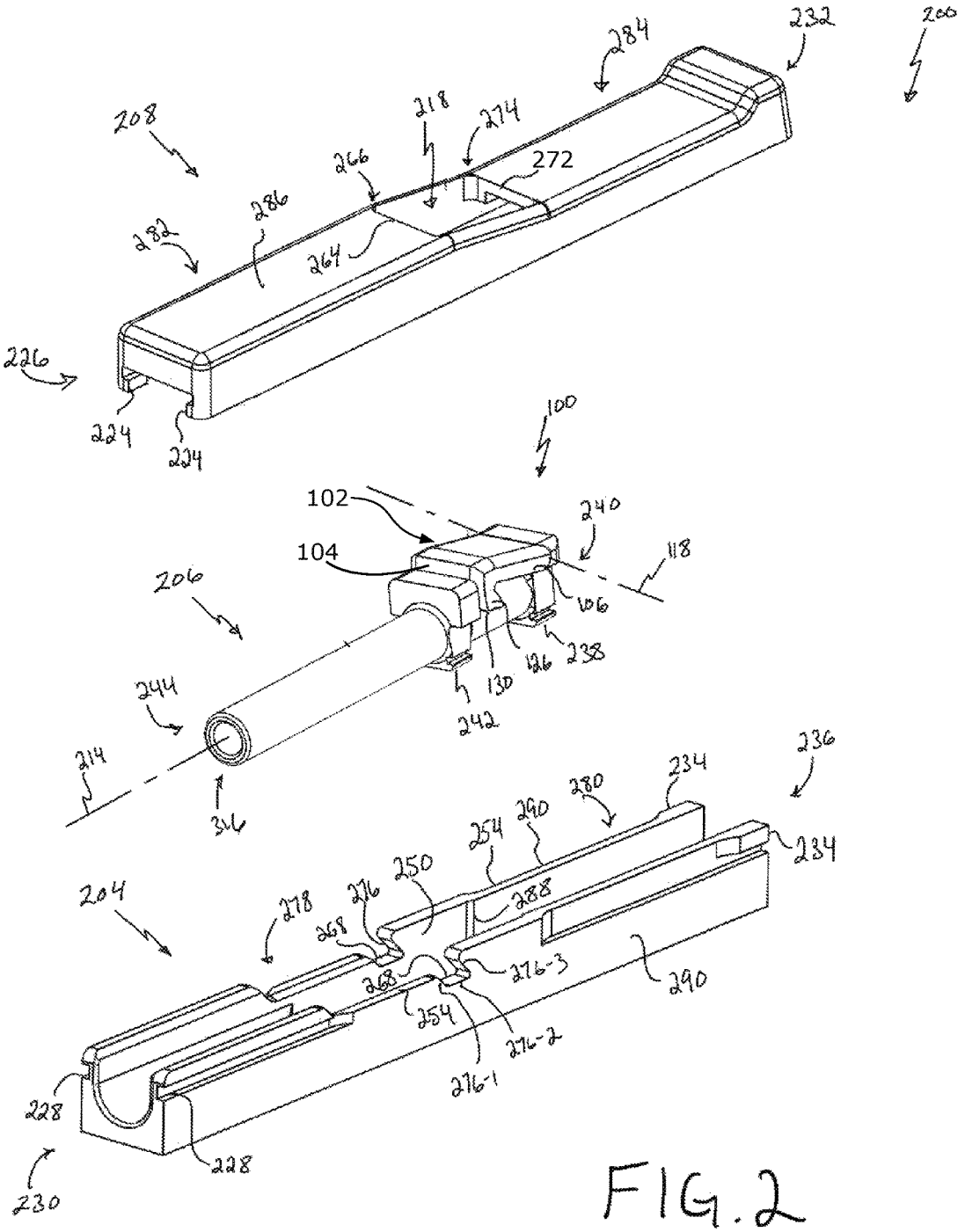
FIG. 2 is a schematic exploded, perspective view of an example of the firearm.

Referring to FIG. 2, in the illustrative example of the disclosed firearm 200, the slide 208 is generally channel-shaped and is slidably mounted to the frame 204 for longitudinal movement relative to the frame 204. The frame 204 is also generally channel-shaped. The barrel 206 fits within and between the frame 204 and the slide 208. In FIG. 2, the handgrip 220 and trigger 216 have been removed from the frame 204 for the sake of simplicity.

In the illustrative example, the slide 208 includes a pair of opposed, inwardly protruding and longitudinally extending forward guide rails 224 disposed proximate to (e.g., at or near) a forward end 226 of the slide 208. These forward guide rails 224 are configured, dimensioned and oriented to engage a pair of opposed, inwardly opening and longitudinally extending forward grooves 228 disposed proximate to a forward end 230 of the frame 204.

Additionally, a pair of inwardly opening and longitudinally extending rearward grooves 260 (FIGS. 4-6) are disposed proximate a rearward end 232 of the slide 208. These rearward grooves 260 are configured, dimensioned and oriented to engage a pair of opposed, outwardly protruding rearward guide rails 234 disposed proximate to a rearward end 236 of the frame 204.

The arrangement of the forward guide rails 224 and forward grooves 228 and the rearward guide rails 234 and rearward grooves 260 retains the slide 208 in its assembled relation with the frame 204 and guides the reciprocal longitudinal movement of the slide 208 along the frame 204.

Alternatively, this relationship may be reversed. As an example (not shown), the slide 208 may include the pair of forward grooves 228 proximate to its forward end 226 and the pair of rearward guide rails 234 proximate to its rearward end 232. The frame 204 may include the pair of forward guide rails 224 proximate to its forward end 230 and the pair of rearward grooves 260 proximate to its rearward end 236. Other configurations of guide rails and grooves may also be used to retain the slide 208 in its assembled relation with the frame 204 and guide the reciprocal longitudinal movement of the slide 208 along the frame 204.

Figure 3:
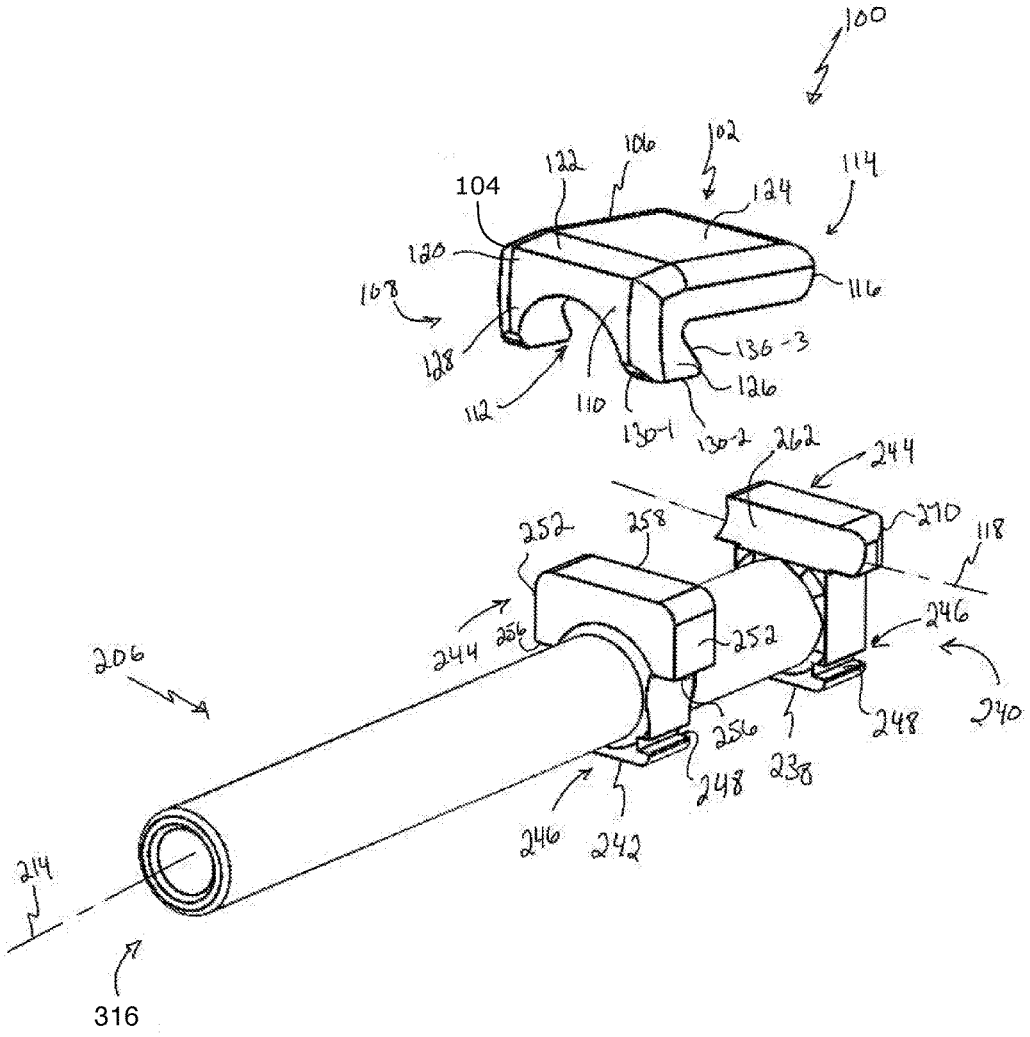
FIG. 3 is a schematic exploded, perspective view of an example of the disclosed locking mechanism for the firearm of FIG. 2.

Referring to FIGS. 2 and 3, in the illustrative example of the disclosed firearm 200, the barrel 206 includes a rearward lug 238 located at a rearward end 240 of the barrel 206. The barrel 206 also includes a forward lug 242 spaced away from and forward of the rearward lug 238 between the rearward end 240 and a forward end 316 of the barrel 206.

Referring to FIG. 3, in the illustrative example, each of the rearward lug 238 and the forward lug 242 include an upper end 244 and an opposed lower end 246. Each of the rearward lug 238 and the forward lug 242 include a pair of opposed, inwardly opening lug grooves 248 disposed on its lower end 246. These lug grooves 248 are configured, dimensioned and oriented to engage a pair of opposed, outwardly protruding and longitudinally extending rails (not shown) disposed on inner surfaces 250 of a pair of opposed sidewalls 290 of the frame 204. The arrangement of rails and lug grooves 248 retains the barrel 206 in its assembled relation with the frame 204 and guides the reciprocal longitudinal movement of the barrel 206 along the frame 204.

Alternatively, this relationship may be reversed. As an example (not shown), the lower end 246 of each of the rearward lug 238 and the forward lug 242 may include the pair of rails and the inner surfaces 250 of the frame 204 may include the pair of grooves. Other configurations of rails and grooves may also be used to retain the barrel 206 in its assembled relation with the frame 204 and guide the reciprocal longitudinal movement of the barrel 206 along the frame 204.

In the illustrative example, the forward lug 242 includes a pair of opposed, outwardly protruding lug guide rails 252 disposed proximate to its upper end 244 in parallel relation with a pair of opposed upper edges 254 of the frame 204 (FIG. 2). Each of the lug guide rail 252 defines a lug shoulder 256 to engage the upper edge 254 of a forward portion 278 of the frame 204. The lug guide rails 252 fit between the upper edges 254 of the frame 204 and the slide 208. The arrangement of the lug guide rails 252 and the upper edges 254 of the frame 204 retains the barrel 206 in its assembled relation with the frame 204 and guides the reciprocal longitudinal movement of the barrel 206 along the frame 204.

Referring to FIG. 2, in the illustrative example, the body 102 includes a block body 106 having a generally rectangular shape in top plan view. The body 102 is configured, dimensioned and oriented to fit between the rearward lug 238 and the forward lug 242 of the barrel 206 on a top of the barrel 206, as best shown in FIG. 2. The body 102 pivots to advance and withdraw the slide lock 104 relative to the ejection port 218 of the slide 208 in response to the longitudinal movement of the slide 208 along the frame 204 between the forward position and the rearward position.

Referring to FIG. 3, the body 102 includes a forward end 108 that includes a forward face 110 to engage a rearward-facing surface 258 of the upper end 244 of the forward lug 242. During pivotal movement of the body 102, the forward face 110 of the body 102 slidably engages the rearward-facing surface 258 of the forward lug 242. In the illustrative example, the forward face 110 of the body 102 and the rearward-facing surface 258 of the forward lug 242 are both planar surfaces.

The forward end 108 of the body 102 also includes a semi-circular or U-shaped opening 112 disposed in the forward face 110 to receive a portion (e.g., a top portion) of the barrel 206.

The body 102 also includes a rearward end 114 that includes a convex rearward face 116 to engage a concave forward-facing surface 262 of the upper end 244 of the rearward lug 238. During pivotal movement of the body 102 about a pivot axis 118 perpendicular to the firing axis 214 of the barrel 206, the convex rearward face 116 of the body 102 slidably engages and rotates within the concave forward-facing surface 262 of the rearward lug 238.

Referring to FIGS. 2 and 3, the slide lock 104 extends upward from the forward end 108 of the body 102. The slide lock 104 extends at least partially through the ejection port 218 of the slide 208 (FIG. 2) and engages a forward shoulder 264 of the slide 208 forming a forward end 266 of the ejection port 218 (FIG. 2). As an example, the slide lock 104 includes, or is formed from, an upper portion 120 (FIG. 3) of the forward face 110 of the body 102. With the body 102 pivotally positioned to engage the barrel 206 and the slide 208 and the slide lock 104 advanced into the ejection port 218 to lock the barrel 206 and the slide 208 together, the upper portion 120 of the forward face 110 extends at least partially through the ejection port 218 and engages the forward shoulder 264 of the ejection port 218.

The body 102 also includes a control surface 122 (FIG. 3) extending upward and rearward from the forward face 110 and a top surface 124 extending downward and rearward from the control surface 122 to the convex rearward face 116. Upon initial pivotal movement of the body 102 in response to rearward movement of the barrel 206 and the slide 208, the forward shoulder 264 of the ejection port 218 (FIG. 2) engages the control surface 122 to urge downward pivotal movement of the body 102 relative to the slide 208.

Referring to FIG. 2, the locking mechanism 100 also includes at least one cam follower 126 extending from the body 102 to engage at least one inwardly opening face cam 268 formed in the frame 204. In the illustrative embodiment, a pair of opposed cam followers 126 extend downward and rearward from the forward end 108 of the body 102 to engage a pair of opposed, inwardly opening face cams 268 formed along the upper edges 254 of the frame 204. Engagement between the cam follower 126 and the face cam 268 pivotally moves the body 102 relative to the slide 208 to advance and withdraw the slide lock 104 relative to the ejection port 218 in response to the longitudinal movement of the slide 208 along the frame 204 between the forward position and the rearward position.

In the illustrative example, the cam follower 126 includes a plurality of follower surfaces 130 that engage (e.g., contact) and move along a plurality of cam control surfaces 276 forming the face cam 268 to control the pivotal movement of the body 102 relative to the barrel 206 and the slide 208. The follower surfaces 130 define a shape of the cam follower 126. The cam control surfaces 276 define a shape of the face cam 268. The shape of cam follower 126 matches the shape of the face cam 268.

Referring to FIG. 3, as an example, a first follower surface 130-1 extends downward and rearward from the forward face 110 of the body 102. A second follower surface 130-2 extends rearward from the first follower surface 130-1. A third follower surface 130-3 extends upward and forward from the second follower surface 130-2 to a bottom surface 132 of the body 102. The cam follower 126 may include additional follower surfaces 130 or a different configuration of follower surfaces 130.

Referring to FIG. 2, similarly, a first cam control surface 276-1 extends downward and rearward from the upper edge 254 of the frame 204. A second cam control surface 276-2 extends rearward from the first cam control surface 276-1. A third cam control surface 276-3 extends upward and forward from the second cam control surface 276-2 to the upper edge 254 of the frame 204. The face cam 268 may include additional cam control surfaces 276 or a different configuration of cam control surfaces 276.

As illustrated in FIG. 2, the upper edges 254 of the forward portion 278 of the frame 204 are positioned lower relative to the upper edges 254 of a rearward portion 280 of the frame 204. This arrangement allows the face cam 268 to capture the cam follower 126 and serve as a stop to the downward pivotal motion of the body 102.

Figure 4:
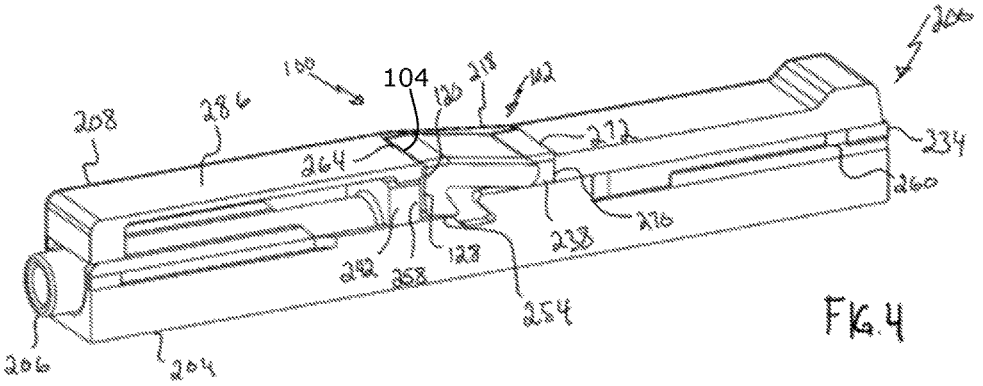
FIG. 4 is a schematic partial, side perspective view of an example of the firearm of FIG. 2 in a fully forward position of a firing cycle.
Figure 5:
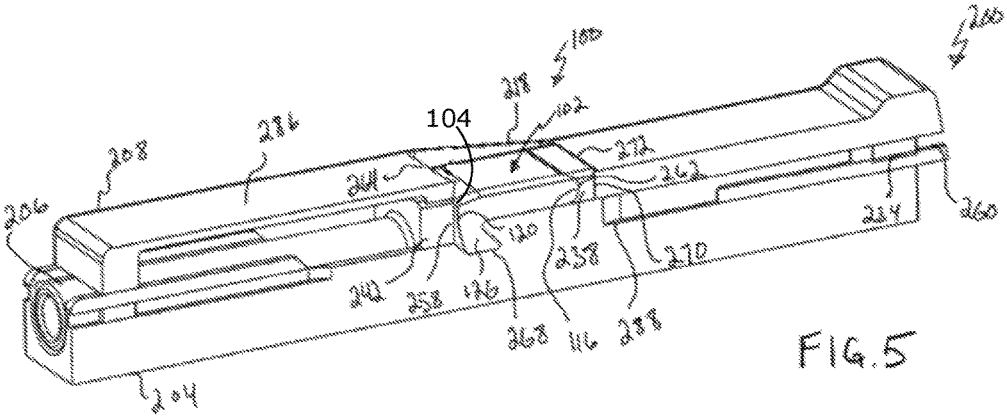
FIG. 5 is a schematic partial, side perspective view of an example of the firearm of FIG. 2 in a partially rearward position of the firing cycle.
Figure 6:
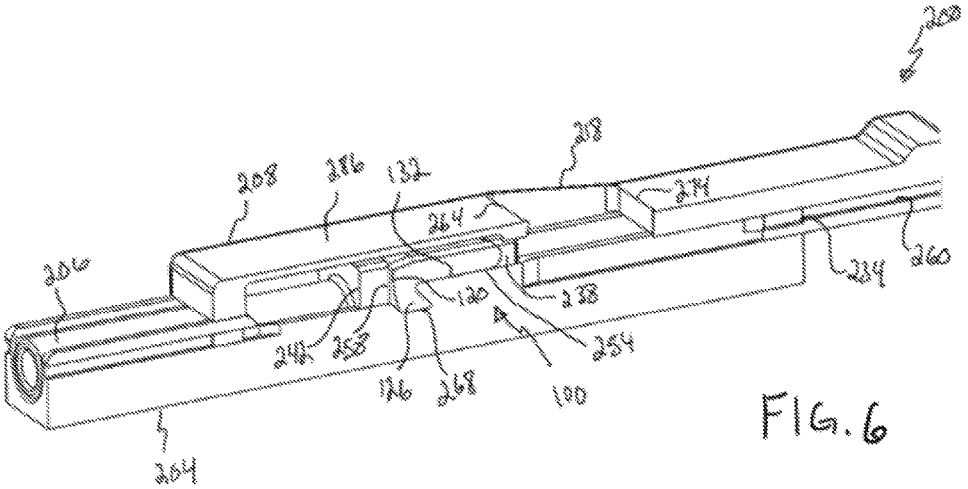
FIG. 6 is a schematic partial, side perspective view of an example of the firearm of FIG. 2 in a fully rearward position of the firing cycle.

FIGS. 4-6 schematically illustrate the short-recoil firing cycle of the disclosed firearm 200. For clarity of illustration, portions of the slide 208 have been removed to make portions of the barrel 206, the locking mechanism 100 and the frame 204 visible. Further, the handgrip 220 and trigger 216 have been removed from the frame 204 for the sake of simplicity.

Referring to FIG. 4, with the barrel 206 and the slide 208 in the fully forward and armed (i.e., ready-to-fire) position, the locking mechanism 100 is engaged with both the barrel 206 and the slide 208 to lock barrel 206 and the slide 208 together. The body 102 is in an upward pivoted and locked position with the slide lock 104 extending at least partially through the ejection port 218.

In this position, a lower portion 128 of the forward face 110 of the body 102 is engaged to the rearward-facing surface 258 of the forward lug 242 of the barrel 206. The upper portion 120 of the forward face 110 of the body 102 extends into the ejection port 218 and is engaged to the forward shoulder 264 of the slide 208 forming the forward end 266 of the ejection port 218. The upper end 244 of the rearward lug 238 of the barrel 206 extends into the ejection port 218. A rearward-facing surface 270 of the rearward lug 238 of the barrel 206 is engaged to a rearward shoulder 272 of the slide 208 forming a rearward end 274 of the ejection port 218.

In this position, the cam follower 126 engages and is supported by the upper edge 254 of the frame 204. As an example, the second follower surface 130-2 (FIG. 4) of the cam follower 126 engages the upper edge 254 of the forward portion 278 (FIG. 2) of the frame 204.

As illustrated in FIGS. 4-6, a forward portion 282 of a top 286 of the slide 208 is positioned higher relative to a rearward portion 284 of the top 286 of the slide 208. This arrangement allows the forward portion 282 of the slide 208 to clear the rearward end 114 (FIG. 4) of the body 102 and the rearward lug 238 of the barrel 206 during longitudinal movement of the slide 208 along the frame 204.

Referring to FIG. 5, after firing, the barrel 206 and the slide 208 remain locked together by the locking mechanism 100 and the slide 208 and the barrel 206 move longitudinally rearward together for a short distance. During rearward movement of the barrel 206, the slide lock 104 engages the forward shoulder 264 of the ejection port 218 and the rearward lug 238 of the barrel 206 engages the rearward shoulder 272 of the ejection port 218.

Near the end of rearward travel of the barrel 206, the cam follower 126 of the locking mechanism 100 engages the face cam 268 of the frame 204 to initiate the downwardly pivoting movement of the body 102 and withdraw the slide lock 104 from the ejection port 218. Rearward movement of the barrel 206 stops when the rearward-facing surface 270 of the rearward lug 238 contacts a pair of opposed, inwardly extending tabs 288 disposed on the inner surfaces 250 of the sidewalls 290 of the rearward portion 280 of the frame 204 (FIG. 2).

Referring to FIG. 5, and with reference to FIGS. 2 and 3, as an example, downward pivotal movement of the body 102 is initiated by engagement of the first follower surface 130-1 (FIG. 3) to the first cam control surface 276-1 (FIG. 2) as the cam follower 126 enters the face cam 268.

Downward pivotal movement of the body 102 withdraws the slide lock 104 from the ejection port 218 to disengage the barrel 206 from the slide 208 and unlock the slide 208 from the barrel 206. As an example, downward pivotal movement of the body 102 withdraws the upper portion 120 of the forward face 110 of the body 102 from the ejection port 218 and disengages the upper portion 120 of the forward face 110 from the forward shoulder 264 of the ejection port 218.

Downward pivotal movement of the body 102 slidably disengages the upper portion 120 of the forward face 110 of the body 102 from the forward shoulder 264 of the ejection port 218 and rotatably engages the rearward face 116 of the body 102 within the forward-facing surface 262 of the rearward lug 238 of the barrel 206. Further downward pivotal movement of the body 102 slidably engages the upper portion 120 of the forward face 110 of the body 102 to the rearward-facing surface 258 of the forward lug 242 of the barrel 206.

As the slide 208 continues its rearward movement, the forward shoulder 264 of the ejection port 218 engages the control surface 122 of the body 102 to further downwardly pivot the body 102 relative to the slide 208 and urge the cam follower 126 within the face cam 268. Downward pivotal movement of the body 102 continues until the third follower surface 130-3 (FIG. 3) of the cam follower 126 engages the third cam control surface 276-3 (FIG. 2) of the face cam 268. Engagement of the third follower surface 130-3 and the third cam control surface 276-3 stops the downward pivotal movement of the body 102. At this point, the locking mechanism 100 has completely disengaged from the slide 208 and the slide 208 is free to continue its rearward movement free from the barrel 206.

Referring to FIG. 6, with the barrel 206 in the fully rearward and stopped position, the locking mechanism 100 is disengaged from the slide 208 and the slide 208 continues its rearward travel. The body 102 is in a downward pivoted and unlocked position with the slide lock 104 withdrawn from the ejection port 218 and located below the top 286 of the slide 208.

In this position, the cam follower 126 is completely engaged with and received by the face cam 268. The upper portion 120 of the forward face 110 of the body 102 engages the rearward-facing surface 258 of the forward lug 242 of the barrel 206.

In this position, the bottom surface 132 of the body 102 engages the upper edges 254 of the rearward portion 280 (FIG. 2) of the frame 204 and the top surface 124 (FIG. 3) of the body 102 is located under and is in approximate parallel relation with the top 286 of the forward portion 282 of the slide 208. At the end of its rearward travel, the slide 208 moves longitudinally forward.

Referring again to FIG. 5, and with reference to FIGS. 2 and 3, during longitudinal forward movement of the slide 208, the locking mechanism 100 re-engages the slide 208 to lock the barrel 206 and the slide 208 together. The body 102 moves from the downwardly pivoted and unlocked position back to the upwardly pivoted and locked position with the slide lock 104 extending within the ejection port 218. During forward movement of the slide 208, the slide 208 moves the barrel 206 and the body 102 forward a short distance to initiate the upward pivotal movement of the body 102 and advance the slide lock 104 into the ejection port 218.

As an example, as the slide 208 continues its forward movement, the rearward shoulder 272 of the ejection port 218 engages the rearward-facing surface 270 of the upper end 244 (FIG. 3) of the rearward lug 238 of the barrel 206. As the barrel 206 and the body 102 move forward, the upward pivotal movement of the body 102 is initiated by engagement of the cam follower 126 and the face cam 268. As an example, upward pivotal movement of the body 102 is initiated by engagement of the first follower surface 130-1 (FIG. 3) of the cam follower 126 to the first cam control surface 276-1 (FIG. 2) of the face cam 268.

As the slide 208, the barrel 206 and the body 102 continue their forward movement, the first follower surface 130-1 (FIG. 3) of the cam follower 126 moves along the first cam control surface 276-1 (FIG. 2) of the face cam 268 as the cam follower 126 exits the face cam 268. Further forward movement of the slide 208, the barrel 206 and the body 102 move the second follower surface 130-2 (FIG. 3) of the cam follower 126 into engagement with the upper edge 254 of the forward portion 278 (FIG. 2) of the frame 204 to complete the upward pivotal movement of the body 102 such that the upper edge 254 supports the cam follower 126 to position the body 102 in the upward pivoted and locked position.

Upward pivotal movement of the body 102 advances the slide lock 104 into the ejection port 218 and engages the slide lock 104 to the forward shoulder 264 of the ejection port 218 to re-engage the barrel 206 with the slide 208 and lock the slide 208 and the barrel 206 together. As an example, upward pivotal movement of the body 102 advances the upper portion 120 of the forward face 110 of the body 102 into the ejection port 218 and engages the upper portion 120 of the forward face 110 to the forward shoulder 264 of the ejection port 218.

The slide 208, the barrel 206 and the body 102 continue longitudinal forward movement until reaching the fully forward and armed position with the locking mechanism 100 engaged with both the barrel 206 and the slide 208 and the barrel 206 and the slide 208 locked together. The body 102 is in the upward pivoted and locked position with the slide lock 104 extending at least partially through the ejection port 218, as shown in FIG. 4.

Referring to FIGS. 7-11, in another example of the disclosed locking mechanism 100 for the firearm 200, the body 102 may move linearly to advance the slide lock 104 into the ejection port 218 and withdraw the slide lock 104 from the ejection port 218. As an example, the body 102 moves linearly downward and rearward relative to the slide 208 to withdraw the slide lock 104 from the ejection port 218 and unlock the slide 208 form the barrel 206 in response to the longitudinal rearward movement of the slide 208. The body 102 moves linearly upward and forward relative to the slide 208 to advance the slide lock 104 within the ejection port 218 to lock the barrel 206 and the slide 208 together in response to the longitudinal forward movement of the slide 208.

Figure 7:
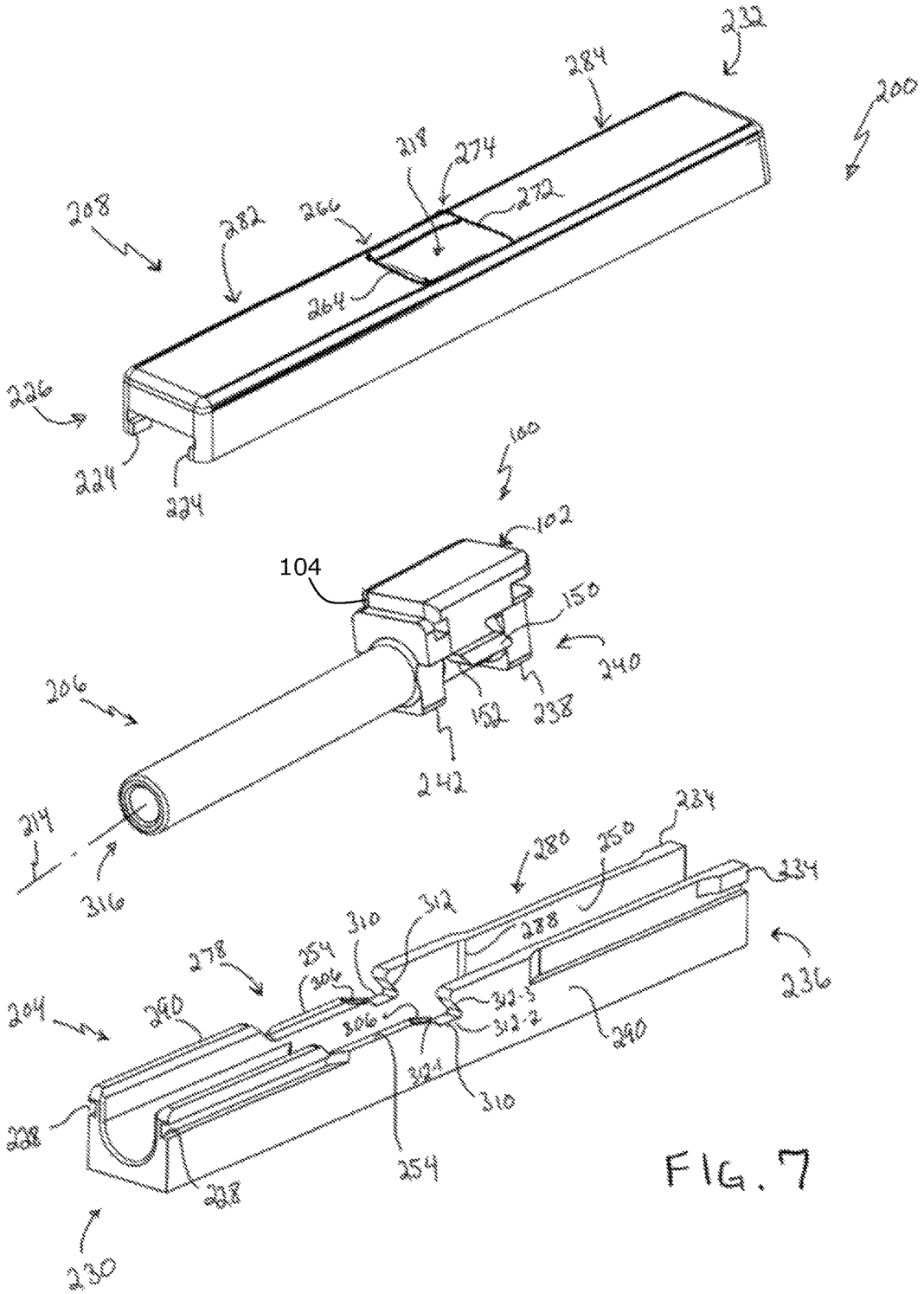
FIG. 7 is a schematic exploded, perspective view of another example of the firearm.

Referring to FIG. 7, in the illustrative example of the disclosed firearm 200, the slide 208 is generally channel-shaped and is slidably mounted to the frame 204 for longitudinal movement relative to the frame 204. The frame 204 is also generally channel-shaped. The barrel 206 fits within and between the frame 204 and the slide 208. In FIG. 7, the handgrip 220 and trigger 216 have been removed from the frame 204 for the sake of simplicity.

As described above, the slide 208 and the frame 204 include an arrangement of the forward guide rails 224 and forward grooves 228 and the rearward guide rails 234 and rearward grooves 260 to retain the slide 208 in its assembled relation with the frame 204 and guide the reciprocal longitudinal movement of the slide 208 along the frame 204.

Figure 8:
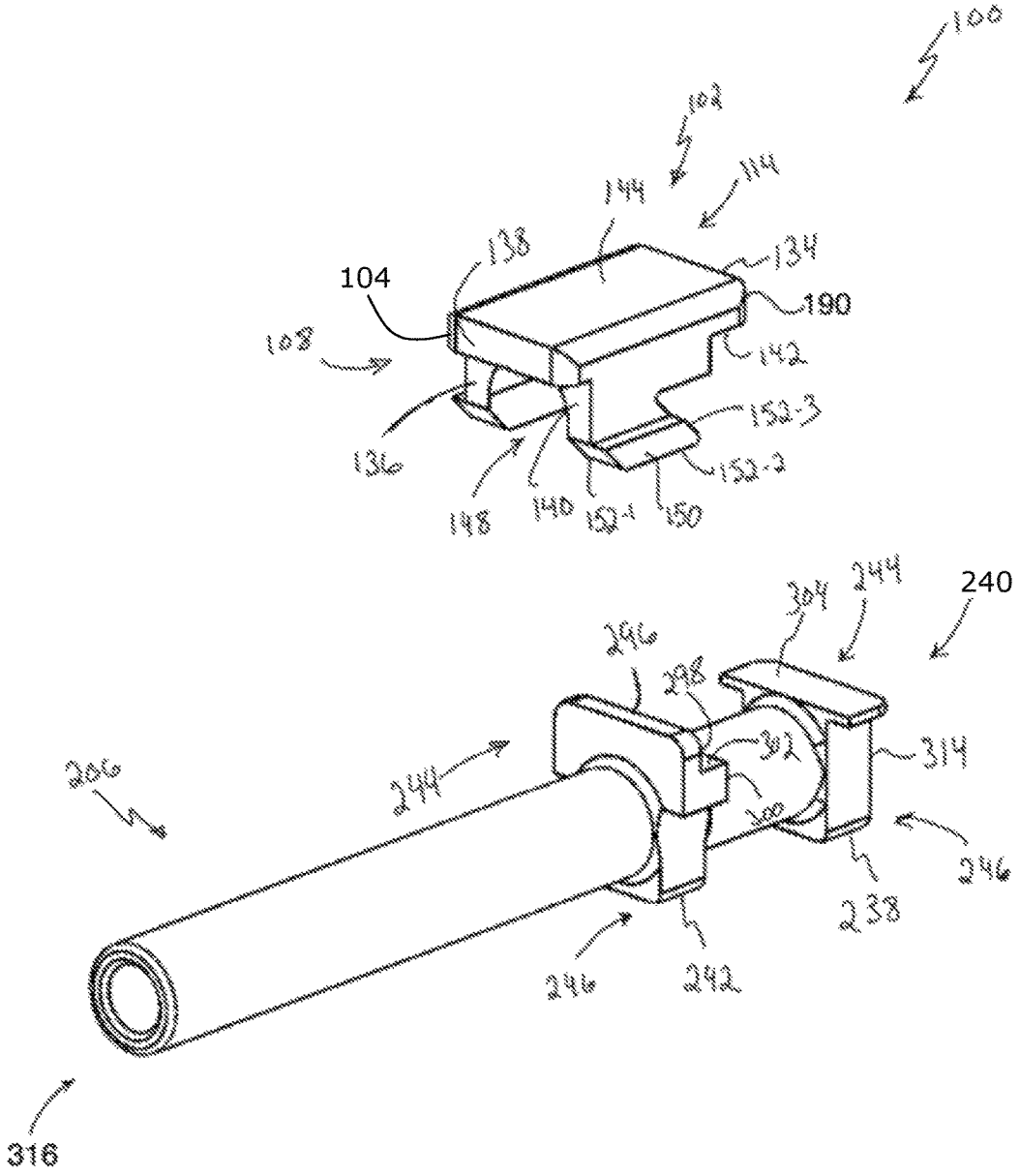
FIG. 8 is a schematic exploded, perspective view of another example of the disclosed locking mechanism for the firearm of FIG. 7.

Referring to FIGS. 7 and 8, in the illustrative example of the disclosed firearm 200, the barrel 206 includes the rearward lug 238 located at the rearward end 240 of the barrel 206 and the forward lug 242 spaced away from and forward of the rearward lug 238 between the rearward end 240 and the forward end 316 of the barrel 206 (FIG. 8).

Each of the rearward lug 238 and the forward lug 242 include the upper end 244 and the opposed lower end 246. The lower ends 246 of the rearward lug 238 and the forward lug 242 fit between the opposed sidewalls 290 of the frame 204 to retain the barrel 206 in its assembled relation with the frame 204 and guide the reciprocal longitudinal movement of the barrel 206 along the frame 204 (FIG. 7).

Referring to FIG. 8, the forward lug 242 includes a pair of opposed, outwardly protruding lug guide rails 292 disposed proximate to its upper end 244 in parallel relation with the pair of opposed upper edges 254 of the frame 204 (FIG. 7). Each of the lug guide rail 292 defines a lug shoulder 294 to engage the upper edge 254 of the frame 204. The lug guide rails 292 fit between the upper edges 254 of the frame 204 and the slide 208. The arrangement of the lug guide rails 292 retains the barrel 206 in its assembled relation with the frame 204 and guides the reciprocal longitudinal movement of the barrel 206 along the frame 204.

Referring to FIGS. 7 and 8, in the illustrative example, the body 102 includes a block body 134 having a generally rectangular shape in top plan view. The body 102 is configured, dimensioned and oriented to fit between the rearward lug 238 and the forward lug 242 of the barrel 206 on the top of the barrel 206, as best shown in FIG. 7. In this example, the body 102 moves linearly upward and downward to advance and withdraw the slide lock 104 relative to the ejection port 218 of the slide 208 in response to the longitudinal movement of the slide 208 along the frame 204 between the forward position and the rearward position.

Referring to FIG. 8, the forward end 108 of the body 102 includes a forward face 136 to engage a rearward-facing surface 296 of the upper end 244 of the forward lug 242. During linear movement of the body 102, the forward face 136 of the body 102 slidably engages the rearward-facing surface 296 of the forward lug 242. As an example, during linear movement of the body 102, a substantially vertical upper portion 138 of the forward face 136 of the body 102 slidably engages a substantially vertical upper portion 298 of the rearward-facing surface 296 of the forward lug 242 and a substantially vertical lower portion 140 of the forward face 136 of the body 102 slidably engages a substantially vertical lower portion 300 of the rearward-facing surface 296 of the forward lug 242. In the illustrative example, the forward face 136 of the body 102 and the rearward-facing surface 296 of the forward lug 242 are both planar surfaces.

The forward end 108 of the body 102 includes a semicircular or U-shaped opening 148 disposed in the lower portion 140 of the forward face 136 to receive a portion (e.g., the top portion) of the barrel 206.

The lower portion 140 of the forward face 136 of is spaced away from and located rearward of the upper portion 138 of the forward face 136 of the body 102. The lower portion 300 of the rearward-facing surface 296 is spaced away from and located rearward of the upper portion 298 of the rearward-facing surface 296 of the forward lug 242. As an example, the upper end 244 of forward lug 242 includes a generally L-shaped member in side elevation view with substantially vertical member forming the upper portion 298 of the rearward-facing surface 296 and a substantially horizontal member forming the lower portion 300 of the rearward-facing surface 296.

The upper end 244 of the forward lug 242 also includes a substantially horizontal top surface 302 extending between the upper portion 298 of the rearward-facing surface 296 and the lower portion 300 of the rearward-facing surface 296. With the body 102 linearly positioned to engage the barrel 206 and disengage the slide 208 and the slide lock 104 withdrawn from the ejection port 218 of the slide 208 to unlock the slide 208 from the barrel 206, a portion of a bottom surface 142 of the body 102 at the forward end 108 engages and is supported on the top surface 302 of the forward lug 242.

The upper end 244 of the rearward lug 238 includes a substantially horizontal top surface 304. With the body 102 in the downward position and the slide lock 104 withdrawn from the ejection port 218 of the slide 208, a portion of the bottom surface 142 of the body 102 at the rearward end 114 engages and is supported on the top surface 304 of the rearward lug 238.

Referring to FIGS. 7 and 8, the slide lock 104 extends upward from the forward end 108 and the rearward end 114 of the body 102. The slide lock 104 extents at least partially through the ejection port 218 and engages the forward shoulder 264 of the slide 208 defining the forward end 266 of the ejection port 218 and a rearward shoulder 272 of the slide 208 defining a rearward end 274 of the ejection port 218 (FIG. 7). As an example, the slide lock 104 includes, of is formed from, the upper portion 138 of the forward face 136 of the body 102 and a rearward face 190 of the body 102. With the body 102 linearly positioned to engage the barrel 206 and the slide 208 and the slide lock 104 advanced into the ejection port 218 of the slide 208 to lock the slide 208 and the barrel 206 together, the upper portion 138 of the forward face 136 extends at least partially through the ejection port 218 and engages the forward shoulder 264 of the ejection port 218 and the rearward face 190 extends at least partially through the ejection port 218 and engages the rearward shoulder 272 of the ejection port 218.

Referring to FIG. 7, the locking mechanism 100 also includes at least one cam follower 150 extending from the body 102 to engage at least one inwardly opening face cam 310 formed in the frame 204. In the illustrative embodiment, a pair of opposed cam followers 150 extend downward and rearward from the forward end 108 of the body 102 to engage a pair of opposed, inwardly opening face cams 310 formed along the upper edges 254 of the frame 204. Engagement between the cam follower 150 and the face cam 310 linearly moves the body 102 relative to the slide 208 to advance and withdraw the slide lock 104 relative to the ejection port 218 in response to the longitudinal movement of the slide 208 along the frame 204 between the forward position and the rearward position.

In the illustrative example, the cam follower 150 includes a plurality of follower surfaces 152 that engage (e.g., contact) and move along a plurality of cam control surfaces 312 forming the face cam 310 to control the linear movement of the body 102 relative to the barrel 206 and the slide 208. The follower surfaces 152 define a shape of the cam follower 150. The cam control surfaces 312 define a shape of the face cam 310. The shape of cam follower 150 matches the shape of the face cam 310.

Referring to FIG. 8, as an example, a first follower surface 152-1 extends downward and rearward from the lower portion 140 of the forward face 136 of the body 102. A second follower surface 152-2 extends rearward from the first follower surface 152-1. A third follower surface 152-3 extends upward and forward from the second follower surface 152-2 to a bottom surface 142 of the body 102. The cam follower 150 may include additional follower surfaces 152 or a different configuration of follower surfaces 152.

Referring to FIG. 7, similarly, a first cam control surface 312-1 extends downward and rearward from the upper edge 254 of the frame 204. A second cam control surface 312-2 extends rearward from the first cam control surface 312-1. A third cam control surface 312-3 extends upward and forward from the second cam control surface 312-2 to the upper edge 254 of the frame 204. The face cam 310 may include additional cam control surfaces 312 or a different configuration of cam control surfaces 312.

As illustrated in FIG. 7, the upper edges 254 of the forward portion 278 of the frame 204 are positioned lower relative to the upper edges 254 of the rearward portion 280 of the frame 204. This arrangement allows the face cam 310 to capture the cam follower 150 and serve as a stop to the downward and rearward linear motion of the body 102.

Figure 9:
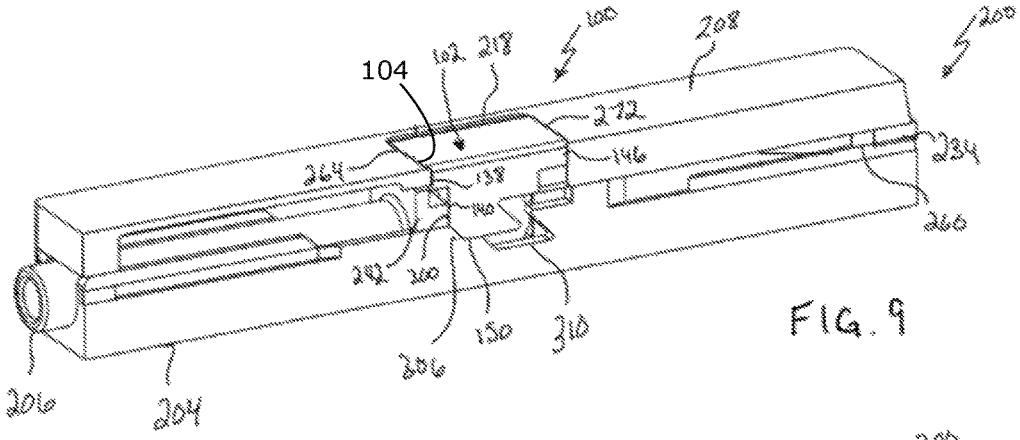
FIG. 9 is a schematic partial, side perspective view of an example of the firearm of FIG. 7 in a fully forward position of a firing cycle.
Figure 10:
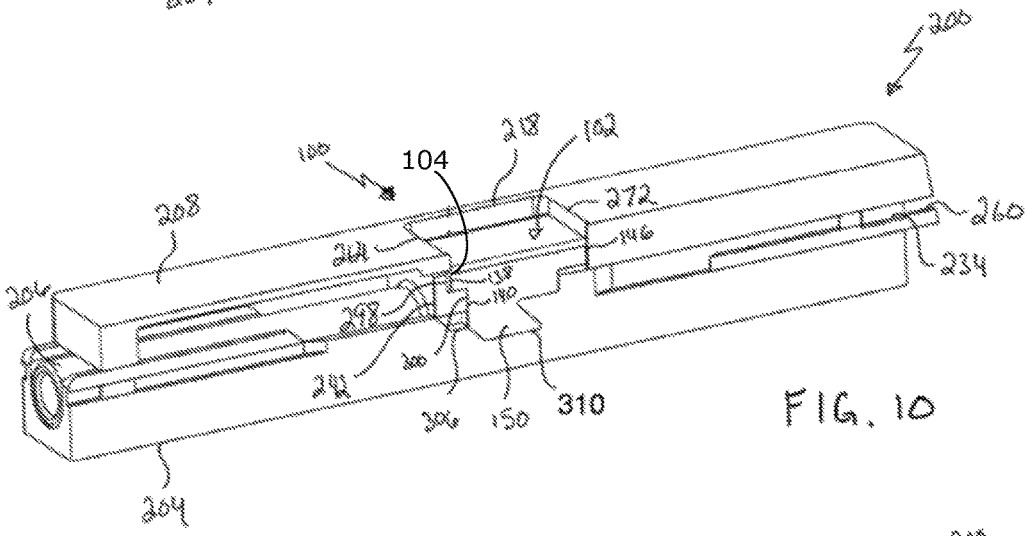
FIG. 10 is a schematic partial, side perspective view of an example of the firearm of FIG. 7 in a partially rearward position of the firing cycle.
Figure 11:
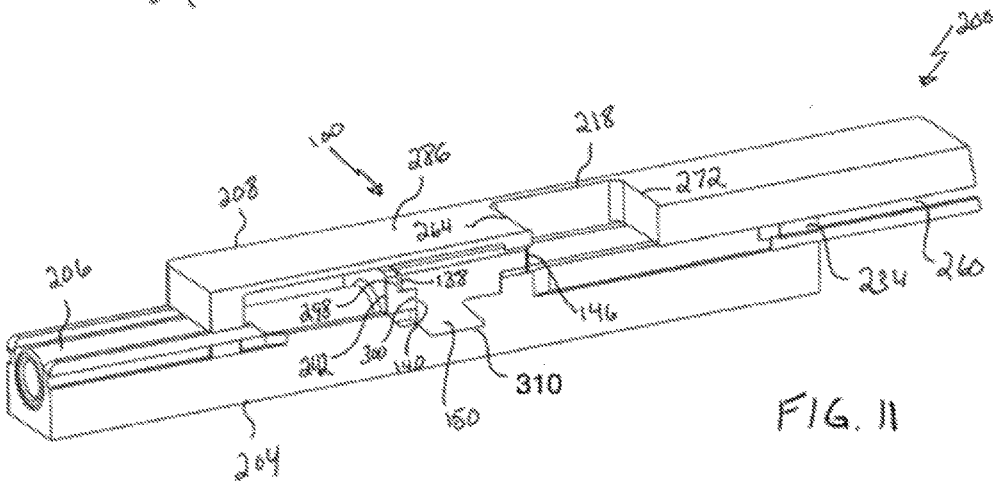
FIG. 11 is a schematic partial, side perspective view of an example of the firearm of FIG. 7 in a fully rearward position of the firing cycle.

FIGS. 9-11 schematically illustrate the short-recoil firing cycle of the disclosed firearm 200. For clarity of illustration, portions of the slide 208 have been removed to make portions of the barrel 206, the locking mechanism 100 and the frame 204 visible. Further, the handgrip 220 and trigger 216 have been removed from the frame 204 for the sake of simplicity.

Referring to FIG. 9, with the barrel 206 and the slide 208 in the fully forward and armed (i.e., ready-to-fire) position, the locking mechanism 100 is engaged with both the barrel 206 and the slide 208 and the barrel 206 and the slide 208 are locked together. The body 102 is in an upward and forward linearly moved and locked position with the slide lock 104 extending at least partially through the ejection port 218.

In this position, the lower portion 140 of the forward face 136 (FIG. 8) of the body 102 is engaged to the lower portion 300 of the rearward-facing surface 296 (FIG. 8) of the forward lug 242 of the barrel 206. The upper portion 138 of the forward face 136 of the body 102 extends into the ejection port 218 and is engaged to the forward shoulder 264 of the slide 208 forming the forward end 266 of the ejection port 218. The rearward face 146 of the body 102 extends into the ejection port 218 and is engaged to the rearward shoulder 272 of the slide 208 forming the rearward end 274 of the ejection port 218.

In this position, the cam follower 150 engages the upper edge 254 of the frame 204. As an example, the second follower surface 152-2 (FIG. 8) of the cam follower 150 engages the upper edge 254 of the forward portion 278 (FIG. 7) of the frame 204.

Referring to FIG. 10, after firing, the barrel 206 and the slide 208 remain locked together by the locking mechanism 100 and the slide 208 and the barrel 206 move longitudinally rearward together for a short distance. During initial rearward movement of the barrel 206, the slide lock 104 engages the forward shoulder 264 and rearward shoulder 272 of the ejection port 218. Near the end of rearward travel of the barrel 206, the cam follower 150 of the locking mechanism 100 engages the face cam 310 of the frame 204 to initiate the downward and rearward linear movement of the body 102 and withdraw the slide lock 104 from the ejection port 218.

Referring to FIG. 10, and with reference to FIGS. 7 and 8, as an example, downward and rearward linear movement of the body 102 is initiated by engagement of the first follower surface 152-1 (FIG. 8) to the first cam control surface 312-1 (FIG. 7) as the cam follower 150 enters the face cam 310.

Downward and rearward linear movement of the body 102 withdraws the slide lock 104 from the ejection port 218 to disengage the barrel 206 from the slide 208 and unlock the slide 208 from the barrel 206. As an example, downward and rearward linear movement of the body 102 withdraws the upper portion 138 of the forward face 136 (FIG. 8) and the rearward face 146 of the body 102 from engagement with the ejection port 218.

Downward and rearward linear movement of the body 102 slidably disengages the upper portion 138 of the forward face 136 of the body 102 from the forward shoulder 264 of the ejection port 218 and slidably disengages the rearward face 146 of the body 102 from the rearward shoulder 272 of the ejection port 218. Further downward and rearward linear movement of the body 102 slidably engages the upper portion 138 of the forward face 136 of the body 102 to the upper portion 298 of the rearward-facing surface 296 (FIG. 8) of the forward lug 242. Downward and rearward linear movement of the body 102 also slidably engages the lower portion 140 of the forward face 136 to the lower portion 300 of the rearward-facing surface 296 of the forward lug 242.

Downward and rearward linear movement of the body 102 continues until the third follower surface 152-3 (FIG. 8) of the cam follower 150 engages the third cam control surface 312-3 (FIG. 7) of the face cam 310. Engagement of the third follower surface 152-3 and the third cam control surface 312-3 stops the downward and rearward linear movement of the body 102.

Rearward movement of the barrel 206 stops when a rearward-facing surface 314 (FIG. 8) of the rearward lug 238 contacts the pair of opposed, inwardly extending tabs 288 (FIG. 7) disposed on the inner surfaces 250 of the sidewalls 290 of the rearward portion 280 of the frame 204. At this point, the locking mechanism 100 has completely disengaged from the slide 208 and the slide 208 is free to continue its rearward movement free from the barrel 206.

Referring to FIG. 11, with the barrel 206 in the fully rearward and stopped position, the locking mechanism 100 is disengaged from the slide 208 and the slide 208 continues its rearward travel. The body 102 is in a downward and rearward linearly moved and unlocked position with the slide lock 104 withdrawn from the ejection port 218 and located below the top 286 of the slide 208.

In this position, the cam follower 150 is completely engaged with and received by the face cam 310. The upper portion 138 of the forward face 136 of the body 102 engages the upper portion 298 of the rearward-facing surface 296 of the forward lug 242 of the barrel 206 and the lower portion 140 of the forward face 136 of the body 102 engages the lower portion 300 of the rearward-facing surface 296 of the forward lug 242.

In this position, the bottom surface 142 at the forward end 108 (FIG. 8) of the body 102 engages the top surface 302 (FIG. 8) of the forward lug 242 and the bottom surface 142 at the rearward end 114 (FIG. 8) of the body 102 engages the top surface 304 (FIG. 8) of the rearward lug 238 and the upper edges 254 (FIG. 7) of the rearward portion 280 of the frame 204. The top surface 144 (FIG. 8) of the body 102 is located under and is in approximate parallel relation with the top 286 of the forward portion 282 of the slide 208. At the end of its rearward travel, the slide 208 moves longitudinally forward.

Referring again to FIG. 10, and with reference to FIGS. 7 and 8, during longitudinal forward movement of the slide 208, the locking mechanism 100 re-engages the slide 208 to lock the barrel 206 and the slide 208 together. The body 102 moves from the downward and rearward linearly moved and unlocked position back to the upward and forward linearly moved and locked position with the slide lock 104 extending within the ejection port 218. During forward movement of the slide 208, the slide 208 moves the barrel 206 and the body 102 forward a short distance to initiate the upward and forward linear movement of the body 102 and advance the slide lock 104 into the ejection port 218.

As an example, as the slide 208 continues its forward movement, the rearward shoulder 272 of the ejection port 218 engages the rearward face 146 of the body 102. As the barrel 206 and the body 102 move forward, the upward and forward linear movement of the body 102 is initiated by engagement of the cam follower 150 and the face cam 310. As an example, upward and forward linear movement of the body 102 is initiated by engagement of the first follower surface 152-1 (FIG. 8) of the cam follower 150 to the first cam control surface 312-1 (FIG. 7) of the face cam 310.

As the slide 208, the barrel 206 and the body 102 continue their forward movement, the first follower surface 152-1 moves along the first cam control surface 312-1 as the cam follower 150 exits the face cam 310. Further forward movement of the slide 208, the barrel 206 and the body 102 moves the cam follower 150 into a seat 306 formed in the upper edge 254 of the sidewalls 290 of the frame 204. As an example, the first follower surface 152-1 and the second follower surface 152-2 engage the upper edges 254 of the sidewalls 290 of the frame 204 to complete the upward and forward linear movement of the body 102 such that the seat 306 supports the cam follower 150 to position the body 102 in the upward and forward linearly moved and locked position.

Upward and forward linear movement of the body 102 advances the slide lock 104 into the ejection port 218 and engages the slide lock 104 to the forward shoulder 264 and the rearward shoulder 272 of the slide 208 forming the ejection port 218 to re-engage the barrel 206 with the slide 208 and lock the slide 208 and the barrel 206 together. As an example, upward and forward linear movement of the body 102 advances the upper portion 138 of the forward face 136 and the rearward face 146 of the body 102 into the ejection port 218 and engages the upper portion 138 of the forward face 136 to the forward shoulder 264 and engages the rearward face 146 to the rearward shoulder 272.

The slide 208, the barrel 206 and the body 102 continue longitudinal forward movement until reaching the fully forward and armed position with the locking mechanism 100 engaged with both the barrel 206 and the slide 208 and the barrel 206 and the slide 208 locked together. The body 102 is in the upward and forward pivoted and locked position with the slide lock 104 extending at least partially through the ejection port 218, as shown in FIG. 9.

Referring to FIGS. 12-17, in another example of the disclosed locking mechanism 100 for the firearm 200, the body 102 may rotate to advance the slide lock 104 into the ejection port 218 and withdraw the slide lock 104 from the ejection port 218. As an example, the body 102 rotates in a first direction relative to the slide 208 to withdraw the slide lock 104 from the ejection port 218 and unlock the slide 208 from the barrel 206 in response to the longitudinal rearward movement of the slide 208. The body 102 rotates in a second direction, opposite the first direction, (e.g., counter-rotates) relative to the slide 208 to advance the slide lock 104 within the ejection port 218 to lock the barrel 206 and the slide 208 together in response to the longitudinal forward movement of the slide 208.

Figure 12:
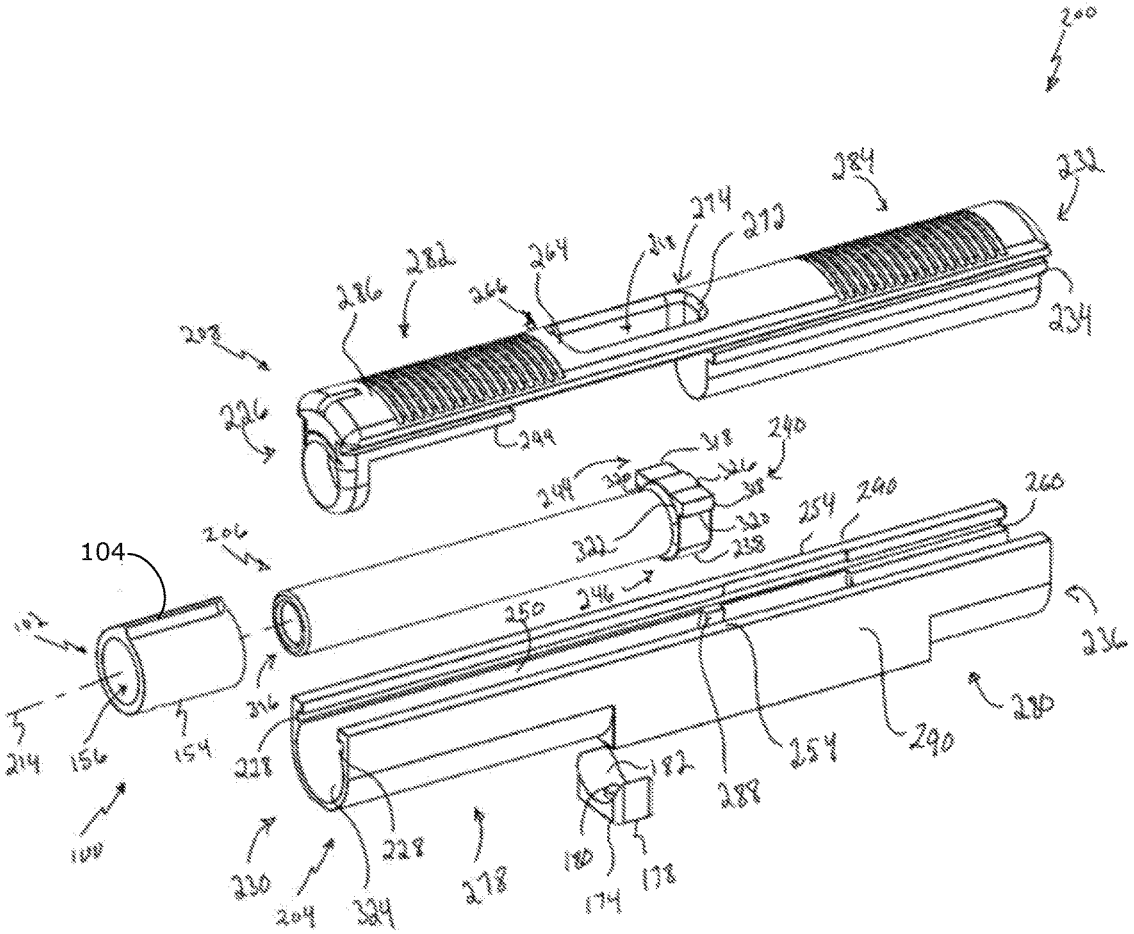
FIG. 12 is a schematic exploded, perspective view of another example of the firearm.

Referring to FIG. 12, in the illustrative example of the disclosed firearm 200, the slide 208 is generally channel-shaped and is slidably mounted to the frame 204 for longitudinal movement relative to the frame 204. The frame 204 is also generally channel-shaped. The barrel 206 fits within and between the frame 204 and the slide 208. In FIG. 12, the handgrip 220 and trigger 216 have been removed from the frame 204 for the sake of simplicity.

As described above, the slide 208 and the frame 204 include an arrangement of the forward guide rails 224 and forward grooves 228 and the rearward guide rails 234 and rearward grooves 260 to retain the slide 208 in its assembled relation with the frame 204 and guide the reciprocal longitudinal movement of the slide 208 along the frame 204.

In the illustrative example of the disclosed firearm 200, the barrel 206 includes the rearward lug 238 located at the rearward end 240 of the barrel 206. The rearward lug 238 includes the upper end 244 and the opposed lower end 246. The lower end 246 of the rearward lug 238 fits between the opposed sidewalls 290 of the frame 204 to retain the barrel 206 in its assembled relation with the frame 204 and guide the reciprocal longitudinal movement of the barrel 206 along the frame 204.

The rearward lug 238 includes a pair of opposed, outwardly protruding lug guide rails 318 disposed proximate to its upper end 244 in parallel relation with the pair of opposed upper edges 254 of the frame 204. Each of the lug guide rail 318 defines a lug shoulder 320 to engage the upper edge 254 of the frame 204. The lug guide rails 318 fit between the upper edges 254 of the frame 204 and the slide 208. The arrangement of the lug guide rails 318 retains the barrel 206 in its assembled relation with the frame 204 and guides the reciprocal longitudinal movement of the barrel 206 along the frame 204.

Figure 13:
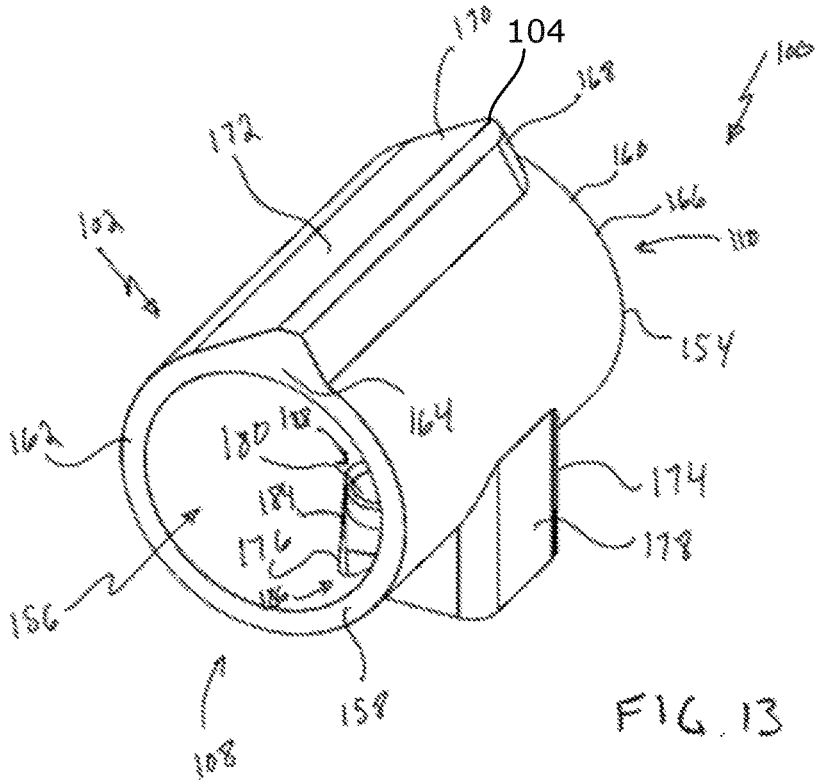
FIG. 13 is a schematic perspective view of another example of the disclosed locking mechanism for the firearm of FIG. 12 in a rotated position.
Figure 14:
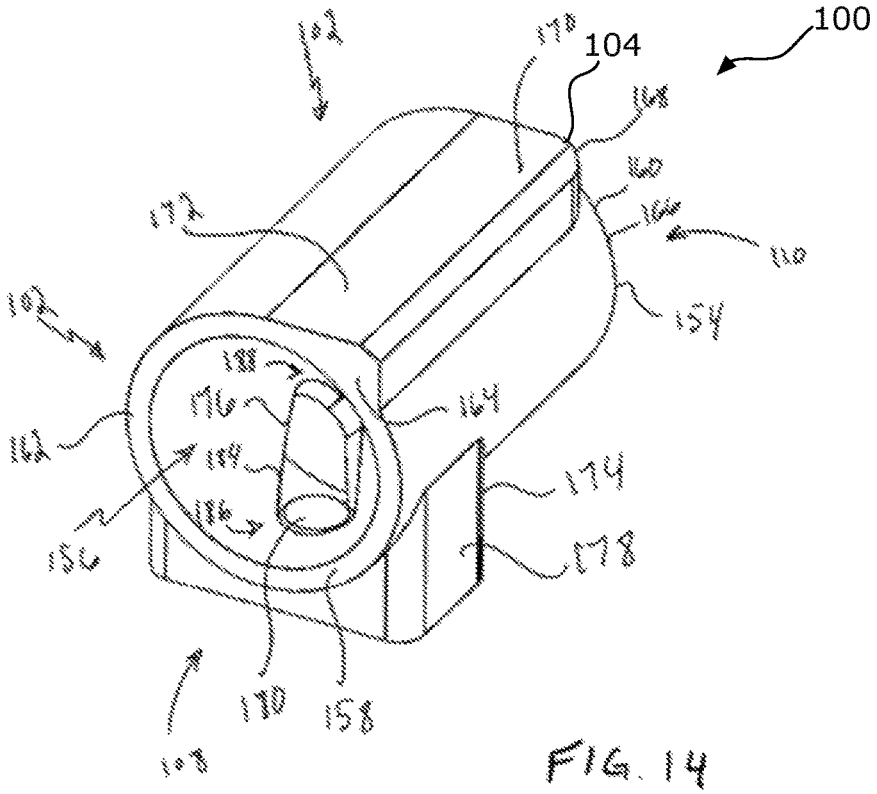
FIG. 14 is a schematic perspective view of the disclosed locking mechanism of FIG. 13 in a counter-rotated position.

Referring to FIGS. 12-14, in the illustrative example, the body 102 includes a tubular body 154 having a generally circular shape in cross-section and defining a passage 156. An extension 170 protrudes tangentially from an exterior of the tubular body 154 and extends from the forward end 108 to the rearward end 114 of the body 102. The body 102 is configured, dimensioned and oriented to receive the barrel 206 through the passage 156 and engage the rearward lug 238. In this example, the body 102 rotates about the firing axis 214 (FIG. 12) of the barrel 206 to advance and withdraw the slide lock 104 relative to the ejection port 218 of the slide 208 in response to the longitudinal movement of the slide 208 along the frame 204 between the forward position and the rearward position.

Referring to FIGS. 13 and 14, the forward end 108 of the body 102 includes a forward face 158 to engage the forward shoulder 264 of the ejection port 218 (FIG. 12). The rearward end 114 of the body 102 includes a rearward face 160 that engages a forward-facing surface 322 of the rearward lug 238 (FIG. 12) and the rearward shoulder 272 of the ejection port 218 (FIG. 12). During rotational movement of the body 102, a portion of the forward face 158 of the body 102 slidably engages the forward shoulder 264 of the ejection port 218 and a portion of the rearward face 160 of the body 102 slidably engages the rearward shoulder 272 of the ejection port 218. As an example, during rotational movement of the body 102, a radial portion 164 of the forward face 158, extending radially outward from a circular portion 162 of the forward face 158, slidably engages the forward shoulder 264 of the ejection port 218. During rotational movement of the body 102, a circular portion 166 of the rearward face 160 of the body 102 slidably engages the forward-facing surface 322 of the rearward lug 238. During rotational movement of the body 102, a radial portion 168 of the rearward face 160, extending radially outward from the circular portion 166 of the rearward face 160, slidably engages the rearward shoulder 272 of the ejection port 218.

The radial portion 164 includes the portion of the forward face 158 formed by the extension 170 at the forward end 108. The circular portion 162 is the portion of the forward face 158 formed by the tubular body 154 at the forward end 108. The radial portion 168 includes the portion of the rearward face 160 formed by the extension 170 at the rearward end 114. The circular portion 166 is the portion of the rearward face 160 formed by the tubular body 154 at the rearward end 114.

Referring to FIGS. 12-14, the slide lock 104 extends tangentially outward from the body 102. The slide lock 104 extends at least partially through the ejection port 218 and engages the forward shoulder 264 of the slide 208 defining the forward end 266 of the ejection port 218 and the rearward shoulder 272 of the slide 208 defining the rearward end 274 of the ejection port 218 (FIG. 12). As an example, the slide lock 104 includes, or is formed from, the extension 170. As an example, the slide lock 104 includes, or is formed from, the radial portion 164 of the forward face 158 of the body 102 formed by the extension 170 and the radial portion 168 of the rearward face 160 of the body 102 formed by the extension 170. With the body 102 rotatably positioned to engage the barrel 206 and the slide 208 and the slide lock 104 advanced into the ejection port 218 of the slide 208 to lock the slide 208 and the barrel 206 together, the radial portion 164 of the forward face 158 extends at least partially through the ejection port 218 and engages the forward shoulder 264 of the ejection port 218 and the radial portion 168 of the rearward face 160 extends at least partially through the ejection port 218 and engages the rearward shoulder 272 of the ejection port 218.

Referring still to FIGS. 12-14, the locking mechanism 100 includes a cam follower 174 coupled to and extending upward from a bottom surface 324 of the frame 204 (FIG. 12) to engage an open face cam 176 (FIGS. 13 and 14) formed through the body 102. Engagement between the cam follower 174 and the face cam 176 rotates the body 102 relative to the slide 208 to advance and withdraw the slide lock 104 relative to the ejection port 218 in response to the longitudinal movement of the slide 208 along the frame 204 between the forward position and the rearward position.

In the illustrative embodiment, the cam follower 174 includes a base 178. The base 178 is fixed relative to the forward portion 278 of the frame 204. The base 178 includes a concave surface 182 dimensioned to receive a portion (e.g., a bottom portion) of the body 102 (e.g., the tubular body 154). The cam follower 174 also includes a stud 180 protruding outward from the concave surface 182 of the base 178.

Referring to FIGS. 13 and 14, as an example, the face cam 176 includes, or is formed from, a slot 184 (or groove) formed through the body 102 approximately opposite the extension 170. A portion of the stud 180 extends at least partially within and is captured by the slot 184. The face cam 176 is configured, dimensioned and oriented to rotate the body 102 as the slot 184 moves rearward and forward along the stud 180. As an example, as the body 102 moves longitudinally rearward and forward, engagement between the slot 184 of the face cam 176 and the fixed stud 180 of the cam follower 174 rotates the body 102 as the slot 184 moves along the stud 180. As an example, the face cam 176 is configured to rotate the body 102 approximately 20-degrees as the slot 184 moves rearward and forward along the stud 180.

As shown in FIG. 13, with the stud 180 of the cam follower 174 positioned proximate to (e.g., at or near) a rearward end 188 of the slot 184 of the face cam 176, the cam follower 174 rotatably positions the body 102 such that the slide lock 104 extends within the ejection port 218 of the slide 208 (FIG. 12) to lock the barrel 206 and the slide 208 together. As an example, with the stud 180 of the cam follower 174 positioned proximate to the rearward end 188 of the slot 184 of the face cam 176, the extension 170 is rotatably positioned within the ejection port 218 such that the radial portion 164 of the forward face 158 of the body 102 engages the forward shoulder 264 of the ejection port 218 (FIG. 12) and the radial portion 168 of the rearward face 160 of the body 102 engages the rearward shoulder 272 of the ejection port 218 (FIG. 12).

As shown in FIG. 14, with the stud 180 of the cam follower 174 positioned proximate to (e.g., at or near) a forward end 186 of the slot 184 of the face cam 176, the cam follower 174 rotatably positions the body 102 such that the slide lock 104 is withdrawn from the ejection port 218 of the slide 208 (FIG. 12) to unlock the slide 208 form the barrel 206. As an example, with the stud 180 of the cam follower 174 positioned proximate to the forward end 186 of the slot 184 of the face cam 176, the extension 170 is rotatably positioned away from the ejection port 218 such that the radial portion 164 of the forward face 158 of the body 102 disengages the forward shoulder 264 of the ejection port 218 (FIG. 12) and the radial portion 168 of the rearward face 160 of the body 102 disengages the rearward shoulder 272 of the ejection port 218 (FIG. 12).

Referring to FIG. 12, in an example, the cam follower 174 is biased into contact with the face cam 176 of the body 102. As an example, a spring (not shown) may be positioned between the base 178 of the cam follower 174 and the frame 204 to bias the cam follower 174 in an upward and engaged position. The cam follower 174 may be depressed to disengage the cam follower 174 from the face cam 176, for example, to remove the barrel 206 from the frame 204.

Figure 15:
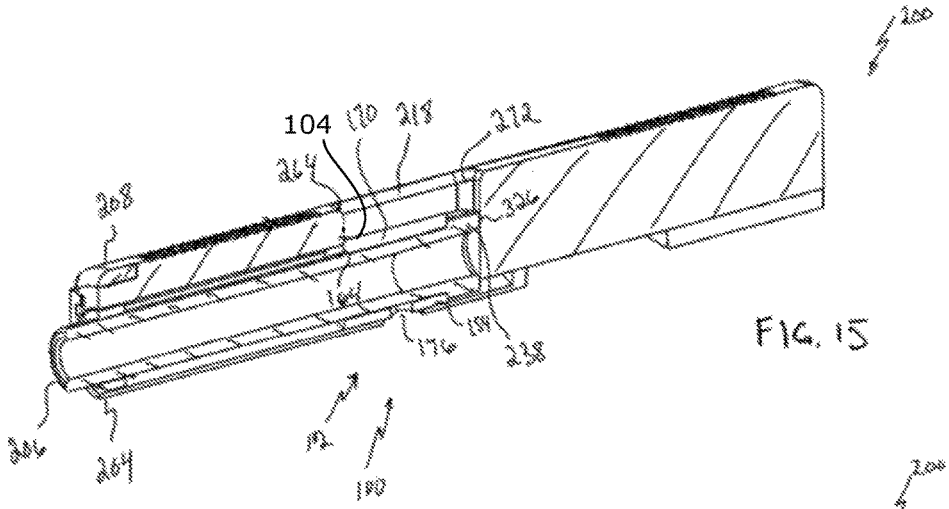
FIG. 15 is a schematic partial, side perspective view, in cross-section, of an example of the firearm of FIG. 12 in a fully forward position of a firing cycle.
Figure 16:
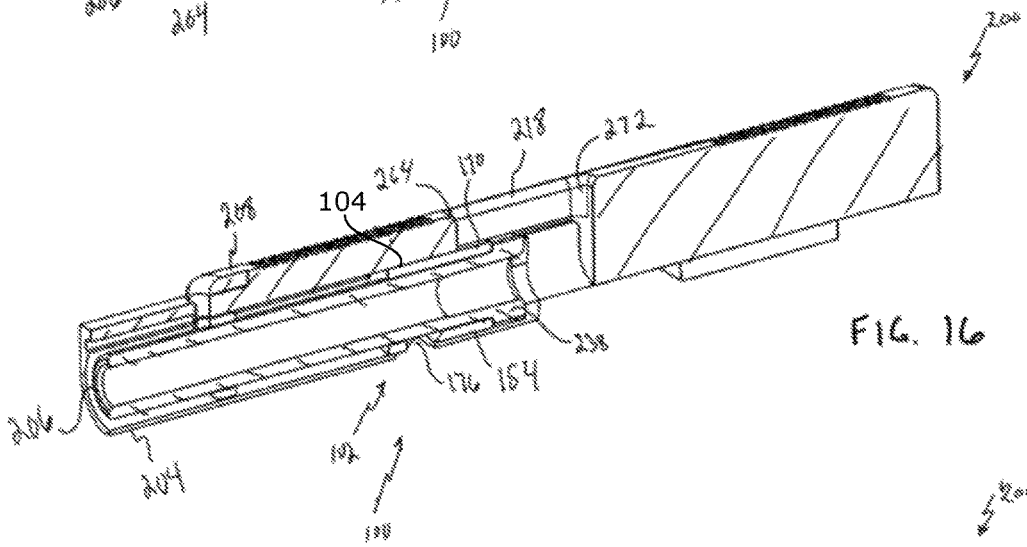
FIG. 16 is a schematic partial, side perspective view, in cross-section, of an example of the firearm of FIG. 12 in a partially rearward position of the firing cycle.
Figure 17:
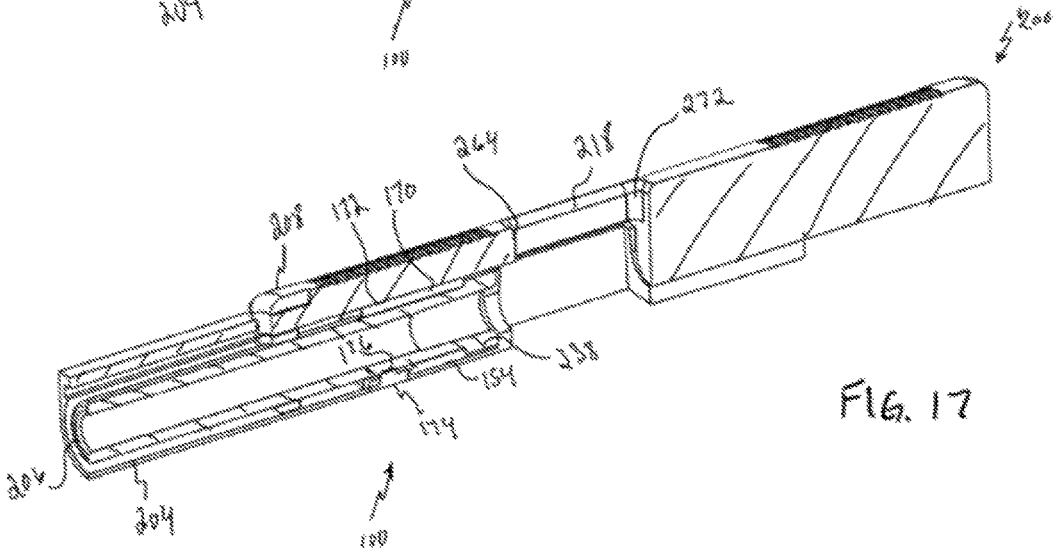
FIG. 17 is a schematic partial, side perspective view, in cross-section, of an example of the firearm of FIG. 12 in a fully rearward position of the firing cycle.

FIGS. 15-17 schematically illustrate the short-recoil firing cycle of the disclosed firearm 200. For clarity of illustration, portions of the slide 208 have been removed to make portions of the barrel 206, the locking mechanism 100 and the frame 204 visible. Further, the handgrip 220 and trigger 216 have been removed from the frame 204 for the sake of simplicity.

Referring to FIG. 15, with the barrel 206 and the slide 208 in the fully forward and armed (i.e., ready-to-fire) position, the locking mechanism 100 is engaged with both the barrel 206 and the slide 208 and the barrel 206 and the slide 208 are locked together. The body 102 is in a rotated and locked position with the slide lock 104 extending at least partially through the ejection port 218.

In this position, the extension 170 is positioned within the ejection port 218. The radial portion 164 of the forward face 158 (FIGS. 13 and 14) of the body 102 extends into the ejection port 218 and is engaged to the forward shoulder 264 of the slide 208 forming the forward end 266 of the ejection port 218. The circular portion 166 of the rearward face 160 (FIGS. 13 and 14) of the body 102 is engaged to the forward-facing surface 322 of the rearward lug 238 of the barrel 206 (FIG. 12). A rearward-facing surface 326 of the rearward lug 238 of the barrel 206 (FIG. 12) is engaged to the rearward shoulder 272 of the slide 208 forming the rearward end 274 of the ejection port 218. The radial portion 168 of the rearward face 160 (FIGS. 13 and 14) of the body 102 extends into the ejection port 218 and is engaged to the rearward shoulder 272 of the slide 208 forming the rearward end 274 of the ejection port 218.

In this position, the stud 180 of the cam follower 174 is positioned at the rearward end 188 of the slot 184 of the face cam 176, as illustrated in FIG. 13.

Referring to FIG. 16, after firing, the barrel 206 and the slide 208 remain locked together by the locking mechanism 100 and the slide 208 and the barrel 206 move longitudinally rearward together for a short distance. During initial rearward movement of the barrel 206, the slide lock 104 engages the forward shoulder 264 and rearward shoulder 272 of the ejection port 218. Near the end of rearward travel of the barrel 206, engagement of the cam follower 174 of the locking mechanism 100 and the face cam 176 initiate the counter-rotation of the body 102 and withdraw the slide lock 104 from the ejection port 218 as the slide 208 drives the body 102 rearward.

Referring to FIG. 16, and with reference to FIGS. 13 and 14, as an example, counter-rotation of the body 102 is initiated by the slot 184 of the face cam 176 moving along a path fixed by the stud 180 of the cam follower 174 as the body 102 moves longitudinally rearward.

Counter-rotation of the body 102 withdraws the slide lock 104 from the ejection port 218 to disengage the barrel 206 from the slide 208 and unlock the slide 208 from the barrel 206. As an example, counter-rotation of the body 102 rotates the extension 170 and withdraws the radial portion 164 of the forward face 158 and the radial portion 168 of the rearward face 160 of the body 102 from engagement with the ejection port 218.

Counter-rotation of the body 102 slidably disengages the radial portion 164 of the forward face 158 of the body 102 from the forward shoulder 264 of the ejection port 218 and slidably disengages the radial portion 168 of the rearward face 160 of the body 102 from the rearward shoulder 272 of the ejection port 218.

Counter-rotation of the body 102 continues until the stud 180 of the cam follower 174 is positioned at the forward end 186 of the slot 184 of the face cam 176, as illustrated in FIG. 14.

Rearward movement of the barrel 206 stops when the rearward-facing surface 326 (FIG. 12) of the rearward lug 238 contacts the pair of opposed, inwardly extending tabs 288 (FIG. 12) disposed on the inner surfaces 250 of the sidewalls 290 of the rearward portion 280 of the frame 204. At this point, the locking mechanism 100 has completely disengaged from the slide 208 and the slide 208 is free to continue its rearward movement free from the barrel 206.

Referring to FIG. 17, with the barrel 206 in the fully rearward and stopped position, the locking mechanism 100 is disengaged from the slide 208 and the slide 208 continues its rearward travel. The body 102 is in a counter-rotated and unlocked position with the slide lock 104 withdrawn from the ejection port 218 and located below the top 286 of the slide 208.

In this position, the stud 180 of the cam follower 174 is positioned at the forward end 186 of the slot 184 of the face cam 176, as illustrated in FIG. 14. A top surface 172 of the extension 170 is located under and is in approximate parallel relation with the top 286 of the forward portion 282 of the slide 208. At the end of its rearward travel, the slide 208 moves longitudinally forward.

Referring again to FIG. 16, and with reference to FIGS. 12-14, during longitudinal forward movement of the slide 208, the locking mechanism 100 re-engages the slide 208 to lock the barrel 206 and the slide 208 together. The body 102 moves from the counter-rotated and unlocked position back to the rotated and locked position with the slide lock 104 extending within the ejection port 218. During forward movement of the slide 208, the slide 208 moves the barrel 206 and the body 102 forward a short distance to initiate the rotation of the body 102 and advance the slide lock 104 into the ejection port 218.

As an example, as the slide 208 continues its forward movement, the rearward shoulder 272 of the ejection port 218 engages the rearward-facing surface 326 (FIG. 12) of the rearward lug 238. As the barrel 206 and the body 102 move forward, rotational movement of the body 102 is initiated by engagement of the cam follower 174 and the face cam 176. As an example, rotational movement of the body 102 is initiated by movement of the slot 184 of the face cam 176 along the path fixed by the stud 180 of the cam follower 174 as the body 102 moves longitudinally forward.

As the slide 208, the barrel 206 and the body 102 continue their forward movement, the stud 180 of the cam follower 174 is positioned at the rearward end 188 of the slot 184 of the face cam 176, as illustrated in FIG. 13.

Rotational movement of the body 102 advances the slide lock 104 into the ejection port 218 and engages the slide lock 104 to the forward shoulder 264 and the rearward shoulder 272 of the slide 208 forming the ejection port 218 to re-engage the barrel 206 with the slide 208 and lock the slide 208 and the barrel 206 together. As an example, rotational movement of the body 102 advances the extension 170 into the ejection port 218 and engages the radial portion 164 of the forward face 158 to the forward shoulder 264 and engages the radial portion 168 of the rearward face 160 to the rearward shoulder 272.

The slide 208, the barrel 206 and the body 102 continue longitudinal forward movement until reaching the fully forward and armed position with the locking mechanism 100 engaged with both the barrel 206 and the slide 208 and the barrel 206 and the slide 208 locked together. The body 102 is in the rotated and locked position with the slide lock 104 extending at least partially through the ejection port 218, as shown in FIG. 15.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example and without limitation, two of item A, one of item B, and ten of item C; four of item B and seven of item C; or some other suitable combination.

As used herein, the terms "approximately" and "about" represent an amount close to the stated amount that still performs the desired function or achieves the desired result. For example, the terms "approximately" and "about" may refer to an amount that is within less than 10% of, within less than 5% of, within less than 1% of, within less than 0.1% of, and within less than 0.01% of the stated amount.

As used herein, the term "substantially" may include exactly and similar, which is to an extent that it may be perceived as being exact. For illustration purposes only and not as a limiting example, the term "substantially" may be quantified as a variance of +/−5% from the exact or actual. For example, the phrase "A is substantially the same as B" may encompass embodiments where A is exactly the same as B, or where A may be within a variance of +/−5%, for example of a value, of B, or vice versa.

As used herein, the terms "partially" or "at least a portion of" may represent an amount of a whole that includes an amount of the whole that may include the whole. For example, the term "a portion of" may refer to an amount that is greater than 0.01% of, greater than 0.1% of, greater than 1% of, greater than 10% of, greater than 20% of, greater than 30% of, greater than 40% of, greater than 50% of, greater than 60%, greater than 70% of, greater than 80% of, greater than 90% of, greater than 95% of, greater than 99% of, and 100% of the whole.

Although various embodiments of the disclosed apparatus, systems and methods have been shown and described, modifications may occur to those skilled in the art upon reading the specification. The present application includes such modifications and is limited only by the scope of the claims.

What is claimed is:

1. A locking mechanism for a firearm comprising a frame, a slide, a barrel and a firing mechanism, said locking mechanism comprising:

a body configured to be located above said barrel, between said barrel and said slide, to engage said barrel; and a slide lock that extends from said body, said slide lock being configured to releasably engage said slide, wherein, with said slide in a forward position, said slide lock is located in an ejection port of said slide to lock said barrel and said slide together.

2. The locking mechanism of claim 1 wherein:

said body is movable relative to said slide in response to longitudinal movement of said slide along said frame between said forward position and a rearward position, movement of said body in response to longitudinal movement of said slide along said frame from said forward position to said rearward position withdraws said slide lock from said ejection port to disengage said barrel from said slide, and movement of said body in response to longitudinal movement of said slide along said frame from said rearward position to said forward position advances said slide lock into said ejection port to engage said barrel with said slide.

3. The locking mechanism of claim 2 wherein said body pivots in response to said longitudinal movement of said slide along said frame between said forward position and a rearward position.

4. The locking mechanism of claim 2 wherein said body moves linearly in response to said longitudinal movement of said slide along said frame between said forward position and a rearward position.

5. The locking mechanism of claim 2 wherein said body rotates in response to said longitudinal movement of said slide along said frame between said forward position and a rearward position.

6. The locking mechanism of claim 2 further comprising a cam follower extending from said body to engage a face cam formed in said frame, and wherein engagement between said cam follower and said face cam moves said body relative to said slide in response to said longitudinal movement of said slide along said frame between said forward position and said rearward position.

7. The locking mechanism of claim 6 wherein engagement between said cam follower and said face cam pivots said body relative to said barrel to engage said slide lock with a forward shoulder of said slide forming a forward end of said ejection port.

8. The locking mechanism of claim 7 further comprising:

a face cam formed in said body; and a cam follower coupled to said frame to engage said face cam, and wherein engagement between said cam follower and said face cam rotates said body relative to said barrel in response to said longitudinal movement of said slide along said frame between said forward position and said rearward position.

9. The locking mechanism of claim 8 wherein said body is a tubular body positioned around said barrel, said tubular body comprising:

a forward face to engage said forward shoulder of said slide; and a rearward face to engage a rearward lug of said barrel and a rearward shoulder of said slide forming a rearward end of said ejection port, and wherein said slide lock comprises a radial portion of said forward face and a radial portion of said rearward face.

10. The locking mechanism of claim 7 wherein said body is a block body positioned over said barrel, said block body comprises:

a forward face to engage a forward lug of said barrel and said forward shoulder of said slide; and a convex rearward face to engage a concave surface of a rearward lug of said barrel, and wherein said slide lock comprises an upper portion of said forward face.

11. The locking mechanism of claim 6 wherein engagement between said cam follower and said face cam linearly moves said body relative to said barrel to engage said slide lock with a forward shoulder of said slide forming a forward end of said ejection port.

12. The locking mechanism of claim 11 wherein said body is a block body positioned over said barrel, said block body comprises:

a forward face to engage a forward lug of said barrel and said forward shoulder of said slide; and a rearward face to engage a rearward shoulder of said slide forming a rearward end of said ejection port, and wherein said slide lock comprises an upper portion of said forward face and said rearward face.

13. A firearm comprising:

a frame;

a barrel coupled to said frame;

a slide coupled to and reciprocally movable relative to said frame, said slide comprising an ejection port; and a locking mechanism located between said barrel and slide, said locking mechanism comprising:

a body engaged to said barrel; and a slide lock extending from said body and releasably engaged with said slide, wherein, with said slide in a forward position, said slide lock is located in said ejection port of said slide to lock said barrel and said slide together.

14. The firearm of claim 13 wherein:

said body pivots relative to said slide in response to longitudinal movement of said slide along said frame between said forward position and a rearward position, downward pivotal movement of said body in response to longitudinal movement of said slide along said frame from said forward position to said rearward position withdraws said slide lock from said ejection port to disengage said barrel from said slide, and upward movement of said body in response to longitudinal movement of said slide along said frame from said rearward position to said forward position advances said slide lock into said ejection port to engage said barrel with said slide.

15. The firearm of claim 13 wherein:

said body linearly moves relative to said slide in response to longitudinal movement of said slide along said frame between said forward position and a rearward position, downward and rearward linear movement of said body in response to longitudinal movement of said slide along said frame from said forward position to said rearward position withdraws said slide lock from said ejection port to disengage said barrel from said slide, and upward and forward linear movement of said body in response to longitudinal movement of said slide along said frame from said rearward position to said forward position advances said slide lock into said ejection port to engage said barrel with said slide.

16. The firearm of claim 13 wherein:

said body rotates relative to said slide in response to longitudinal movement of said slide along said frame between said forward position and a rearward position, counter-rotational movement of said body in response to longitudinal movement of said slide along said frame from said forward position to said rearward position withdraws said slide lock from said ejection port to disengage said barrel from said slide, and rotational movement of said body in response to longitudinal movement of said slide along said frame from said rearward position to said forward position advances said slide lock into said ejection port to engage said barrel with said slide.

17. A method comprising:

positioning a body of a locking mechanism into engagement with a barrel of a firearm;

locating a slide lock of said locking mechanism, extending from said body, in an ejection port of a slide of said firearm and into releasable engagement with said slide; and locking said slide and said barrel together.

18. The method of claim 17 further comprising:

pivoting said body relative to said slide in response to longitudinal movement of said slide along a frame of said firearm between a forward position and a rearward position;

withdrawing said slide lock from said ejection port; and unlocking said slide from said barrel.

19. The method of claim 17 further comprising:

linearly moving said body relative to said slide in response to longitudinal movement of said slide along a frame of said firearm between a forward position and a rearward position;

withdrawing said slide lock from said ejection port; and unlocking said slide from said barrel.

20. The method of claim 17 further comprising:

rotating said body relative to said slide in response to longitudinal movement of said slide along a frame of said firearm between a forward position and a rearward position;

withdrawing said slide lock from said ejection port; and unlocking said slide from said barrel.

* * * * *